US010160202B2

(12) United States Patent
Ito et al.

(10) Patent No.: US 10,160,202 B2
(45) Date of Patent: Dec. 25, 2018

(54) LIQUID DISCHARGING APPARATUS

(71) Applicant: SEIKO EPSON CORPORATION, Tokyo (JP)

(72) Inventors: Sukehiro Ito, Nagano (JP); Naoto Hayakawa, Nagano (JP); Kazunori Hiramatsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/907,523

(22) Filed: Feb. 28, 2018

(65) Prior Publication Data

US 2018/0272700 A1 Sep. 27, 2018

(30) Foreign Application Priority Data

Mar. 22, 2017 (JP) ..... 2017-056642

(51) Int. Cl.

| | |
|---|---|
| ***B41J 2/045*** | (2006.01) |
| ***B41J 2/14*** | (2006.01) |
| ***B41J 2/15*** | (2006.01) |
| ***B41J 11/00*** | (2006.01) |
| ***B41J 19/00*** | (2006.01) |

(52) U.S. Cl.

CPC ..... *B41J 2/04541* (2013.01); *B41J 2/04508* (2013.01); *B41J 2/04581* (2013.01); *B41J 2/1433* (2013.01); *B41J 2/14201* (2013.01); *B41J 2/15* (2013.01); *B41J 11/001* (2013.01); *B41J 19/005* (2013.01); *B41J 2002/14491* (2013.01); *B41J 2202/13* (2013.01)

(58) Field of Classification Search

CPC ..... B41J 2/04541; B41J 2/04508; B41J 2/04581; B41J 19/005; B41J 11/001; B41J 2/15; B41J 2/1433; B41J 2/14202; B41J 2202/14491; B41J 2202/13

See application file for complete search history.

(56) References Cited

U.S. PATENT DOCUMENTS

| | | | | |
|---|---|---|---|---|
| 7,807,926 | B2 * | 10/2010 | Samoto | B41J 29/02 174/254 |
| 8,038,250 | B2 * | 10/2011 | Kubo | B41J 2/14233 347/17 |
| 9,016,833 | B2 * | 4/2015 | Ito | B41J 19/005 347/41 |
| 2014/0192114 | A1 | 7/2014 | Ito et al. | |
| 2018/0117937 | A1 * | 5/2018 | Wang | H01R 12/77 |

FOREIGN PATENT DOCUMENTS

| | | | |
|---|---|---|---|
| JP | 4196523 | B2 | 12/2008 |
| JP | 2014-133358 | A | 7/2014 |

* cited by examiner

*Primary Examiner* — Thinh H Nguyen

(57) ABSTRACT

A liquid discharging apparatus includes a print head that discharges a liquid, a carriage that is mounted on the print head, a control signal generation circuit, a drive signal generation circuit, a first cable through which a drive signal generation control signal is transmitted to the drive signal generation circuit, a second cable through which a drive signal is transmitted to the print head, a control circuit substrate on which the control signal generation circuit is provided, and a drive circuit substrate on which the drive signal generation circuit is provided. The shortest distance between the control circuit substrate and the carriage is longer than the shortest distance between the drive circuit substrate and the carriage. The drive circuit substrate is provided at a position where a region in which the carriage moves and at least a part of the drive circuit substrate overlap each other.

9 Claims, 15 Drawing Sheets

| (SIH, SIM, SIL) | T1 | | T2 | |
|---|---|---|---|---|
| | Sa | Sb | Sa | Sb |
| (1, 1, 0) [LARGE DOT] | H | L | H | L |
| (1, 0, 0) [MEDIUM DOT] | H | L | L | L |
| (0, 1, 0) [SMALL DOT] | L | L | H | L |
| (0, 0, 0) [NON-RECORDING] | L | L | L | L |
| (0, 0, 1) [INSPECTION] | L | H | L | H |

FIG. 19

| CORE NUMBER | FIRST FFC | SECOND FFC | THIRD FFC | FOURTH FFC |
|---|---|---|---|---|
| | FFC194-1 | FFC194-2 | FFC195 | FFC191 |
| 1 | VBS | COM-B1 | GND | GND |
| 2 | COM-A1 | VBS | TH | sSck+ |
| 3 | VBS | COM-B2 | XHOT | sSck- |
| 4 | COM-A2 | VBS | GND | GND |
| 5 | VBS | COM-B3 | GND | sSI+ |
| 6 | COM-A3 | VBS | VDD | sSI+ |
| 7 | VBS | COM-B4 | GND | GND |
| 8 | COM-A4 | VBS | NVT | sLAT+ |
| 9 | VBS | COM-B5 | GND | sLAT- |
| ⋮ | ⋮ | ⋮ | ⋮ | ⋮ |

FIG. 20

| CORE NUMBER | FIFTH FFC | SIXTH FFC | SEVENTH FFC | EIGHTH FFC |
|---|---|---|---|---|
| | FFC192-1 | FFC192-1 | FFC193 | FFC191 |
| 1 | GND | GND | GND | GND |
| 2 | sdA1+ | GND | dVtemp | sSck+ |
| 3 | sdA1- | GND | XHOT | sSck- |
| 4 | GND | GND | GND | GND |
| 5 | sdB1+ | GND | GND | sSI+ |
| 6 | sdB1- | GND | VDD | sSI+ |
| 7 | GND | GND | GND | GND |
| 8 | sdA2+ | GND | dVrbg | sLAT+ |
| 9 | sdA2- | GND | GND | sLAT- |
| ⋮ | ⋮ | ⋮ | ⋮ | ⋮ |

LIQUID DISCHARGING APPARATUS

BACKGROUND

1. Technical Field

The present invention relates to a liquid discharging apparatus.

2. Related Art

An apparatus using a piezoelectric element is known as a liquid discharging apparatus such as an ink jet printer that discharges inks and prints an image or characters. The piezoelectric element is provided so as to correspond to each of a plurality of nozzles in a head (print head), and each of the nozzles is driven in accordance with a drive signal. As a consequence, a predetermined amount of ink (liquid) is discharged at a predetermined timing from the nozzles, and thereby dots are formed. Since the piezoelectric element is a capacitive load like a capacitor from an electrical perspective, it is necessary to supply a sufficient amount of current in order to operate the piezoelectric element of each nozzle. For this reason, a configuration where a drive circuit supplies a drive signal amplified by an amplification circuit and the piezoelectric element is driven is adopted in the liquid discharging apparatus described above.

An ink jet printer, in which a drive circuit supplying a drive signal to a head is integrally provided with a control circuit generating a control signal for controlling driving of the head and a drive circuit generating a drive signal for driving the head, and supplies the drive signal to the print head via a flexible cable, is disclosed in JP-A-2014-133358. A liquid discharging apparatus, in which a moving (reciprocating) carriage, on which a head discharging an ink is mounted and a drive circuit generating a drive signal for controlling the head are integrally provided, is disclosed in Japanese Patent No. 4196523.

However, in a liquid discharging apparatus (for example, a large format printer (LFP)) that performs serial printing onto a medium having a size of A3 or larger, a distance by which a print head moves is long and the length of a cable connecting a print head and a control substrate together is 1 m or longer. Thus, the inductance and impedance of the cable are higher. Therefore, in a liquid discharging apparatus that performs serial printing onto a medium having a size of A3 or larger, a control circuit and a drive circuit are integrally provided as in the ink jet printer disclosed in JP-A-2014-133358. In a case where a control signal and a drive signal are transmitted to a print head via a flexible cable (signal line), there is a possibility that the occurrence of overshoot or undershoot of the drive signal increases due to an effect of inductance of wiring for transmitting the drive signal and the print head breaks down by an overvoltage that exceeds a withstand voltage being instantaneously applied to a circuit mounted on the print head or to a driving element. In addition, printing accuracy or printing stability declines, or malfunction such as false discharging of an ink occurs as the voltage of a drive signal drops significantly due to an effect of impedance of the wiring for transmitting a drive signal. As a signal line through which a drive signal and a control signal are transmitted becomes longer, the occurrence of crosstalk between a drive signal and a control signal increases. Therefore, a control signal with a low voltage is likely to receive an effect of a drive signal with a high voltage, and malfunction such as false discharging occurs.

In the liquid discharging apparatus that performs serial printing onto a medium having a size of A3 or larger, the weight of a movable unit for performing serial printing increases and a load to a motor for reciprocating the movable unit increases if a drive circuit is mounted on a carriage as in the recording apparatus disclosed in Japanese Patent No. 4196523. As a consequence, an expensive motor is necessary and it is difficult to reduce costs. In addition, there is a possibility that discharging accuracy or discharging stability declines due to heat generation in the drive circuit. If the weight of the movable unit increases, vibration increases at the time of reciprocation. Therefore, there is a possibility that printing accuracy or printing stability declines by large vibration of the print head.

SUMMARY

An advantage of some aspects of the invention is to provide a liquid discharging apparatus that can reduce and avoid at least one of problems attributable to an increase in the length of transmission wiring of a drive signal while suppressing an increase in the size of a carriage in the liquid discharging apparatus (for example, a large format printer) that performs printing onto a medium having a size of A3 or larger.

The invention can be realized in the following aspects or application examples.

Application Example 1

According to this application example, there is provided a liquid discharging apparatus that performs serial printing onto a medium having a size of an A3 short side width or larger. The apparatus includes a print head that includes a driving element and discharges a liquid when a drive signal is applied and the driving element is driven, a carriage that is mounted on the print head and moves with respect to the medium, a control signal generation circuit that generates a drive signal generation control signal for controlling generation of the drive signal, a drive signal generation circuit that generates the drive signal based on the drive signal generation control signal, a first cable through which the drive signal generation control signal is transmitted from the control signal generation circuit to the drive signal generation circuit, a second cable through which the drive signal is transmitted from the drive signal generation circuit to the print head, a control circuit substrate on which the control signal generation circuit is provided, and a drive circuit substrate on which the drive signal generation circuit is provided. The shortest distance between the control circuit substrate and the moving carriage is longer than the shortest distance between the drive circuit substrate and the moving carriage. The drive circuit substrate is provided at a position where a region in which the carriage moves and at least a part of the drive circuit substrate overlap each other when seen in a direction orthogonal to a direction where the carriage moves.

The driving element may be, for example, a piezoelectric element, or may be a heater element.

The liquid discharging apparatus according to this application example is a liquid discharging apparatus that performs serial printing by moving the carriage on which the print head is mounted. The drive circuit substrate, on which the drive signal generation circuit generating a drive signal is mounted, is separately provided from the carriage, on which the head is mounted, and from the control circuit substrate on which the control signal generation circuit generating the drive signal generation control signal for controlling the generation of the drive signal is mounted. The drive circuit substrate is disposed so as to overlap the region in which the carriage moves, and the shortest distance between the drive circuit substrate and the carriage is shorter than the shortest distance between the control circuit substrate and the carriage. That is, the drive circuit substrate is disposed closer to the carriage than the control circuit substrate. Therefore, it is possible to make wiring through which the drive signal output from the drive circuit substrate is transmitted shorter while suppressing an increase in the size of the carriage, and it is possible to reduce the stray resistance, stray capacitance, and stray inductance of the wiring through which the drive signal is transmitted. Therefore, it is possible to reduce distortion of the drive signal attributable to an increase in the length of the transmission wiring, and to transmit the drive signal to the driving element with high accuracy. Thus, it is possible to improve the reliability of the liquid discharging apparatus.

Application Example 2

In the liquid discharging apparatus according to the application example, at least a part of the drive circuit substrate may be provided in a middle portion of the region in which the carriage moves when seen in the direction orthogonal to the direction where the carriage moves.

In the liquid discharging apparatus according to the application example, it is possible to make the wired length of the second cable through which the drive signal is transmitted even shorter by disposing the drive circuit substrate in the middle portion of the region in which the carriage moves. Accordingly, it is possible to further reduce stray resistance, stray capacitance, and stray inductance of the wiring through which the drive signal is transmitted. Therefore, it is possible to further reduce distortion of the drive signal attributable to an increase in the length of the transmission wiring, and to transmit the drive signal to the driving element with high accuracy. Thus, it is possible to further improve the reliability of the liquid discharging apparatus.

Application Example 3

In the liquid discharging apparatus according to the application example, at least a part of the control circuit substrate may be provided outside the region in which the carriage moves when seen in the direction orthogonal to the direction where the carriage moves.

In the liquid discharging apparatus according to the application example, the control circuit substrate is provided outside the region in which the carriage moves and the liquid is discharged onto the medium. Accordingly, the sticking of the discharged liquid to the control circuit substrate can be reduced. Therefore, the occurrence of a breakdown caused by an insulation failure of the control circuit substrate resulting from the sticking of the liquid is reduced, and thus it is possible to further improve the reliability of the liquid discharging apparatus.

In the liquid discharging apparatus according to the application example, the control circuit substrate is disposed so as to be separated away from the drive circuit substrate that is provided in the region in which the carriage moves by providing the control circuit substrate outside the region in which the carriage moves and a liquid is discharged onto the medium. That is, it is possible to reduce an effect of heat generated in the drive circuit substrate on the control circuit substrate. Therefore, it is possible to reduce changes in characteristics of the control circuit substrate caused by the heat and the occurrence of a breakdown (for example, a short life) caused by thermal degradation. It is also possible to further improve the reliability of the liquid discharging apparatus.

Application Example 4

In the liquid discharging apparatus according to the application example, a maximum width that allows the serial printing may be equal to or larger than 24 inches and be equal to or smaller than 75 inches.

In a case where the maximum width that allows serial printing is equal to or larger than 24 inches and is equal to or smaller than 75 inches, the impedance and inductance of a signal line increase since the entire length of the signal line through which the drive signal is transmitted is approximately 1 m to 3 m. Therefore, in the liquid discharging apparatus according to the application example, the effect described above, which is obtained by reducing the impedance and inductance of the signal line, is even larger. If the maximum width that allows serial printing exceeds 75 inches, the impedance and inductance of the signal line through which the drive signal is propagated increase excessively and there is a possibility that a breakdown or malfunction of the print head occurs further increases due to overshoot or undershoot of the drive signal. Therefore, the effect described above is unlikely to be obtained.

Application Example 5

In the liquid discharging apparatus according to the application example, a maximum width that allows the serial printing may correspond to any width of the media of 24 inches, 36 inches, 44 inches, and 64 inches.

The liquid discharging apparatus according to the application example can achieve excellent printing accuracy and printing stability as a 24-inch corresponding printer, a 36-inch corresponding printer, a 44-inch corresponding printer, or a 64-inch corresponding printer, which is in particularly high demand.

Application Example 6

In the liquid discharging apparatus according to the application example, the drive signal generation control signal may be a digital signal, the drive signal generation circuit may generate an underlying drive signal, which is an underlying analog signal of the drive signal, based on the drive signal generation control signal, and the drive signal generation circuit may power-amplify the underlying drive signal to generate the drive signal.

In the liquid discharging apparatus according to the application example, the drive signal generation control signal input into the drive signal generation circuit is input as a digital signal. That is, the drive signal generation control signal, which is an underlying signal of the drive signal, is unlikely to receive an effect of external noises. Thus, the drive signal generation control signal is accurately input into the drive signal generation circuit. Therefore, there is a possibility that the accuracy of the drive signal output from the drive signal generation circuit improves.

Application Example 7

In the liquid discharging apparatus according to the application example, the drive signal generation control signal may be a differential signal, the first cable may include first wiring, second wiring, third wiring, fourth wiring, fifth wiring, and sixth wiring, the differential signal may be transmitted through the second wiring and the third wiring, a constant voltage signal may be transmitted through the first wiring, the fourth wiring, the fifth wiring, and the sixth wiring, the second wiring and the fifth wiring may be disposed so as to oppose each other, and the third wiring and the sixth wiring may be disposed so as to oppose each other.

In the liquid discharging apparatus according to the application example, the drive signal generation control signal input into the drive signal generation circuit is a differential signal, and thus the signal is even more unlikely to receive an effect of external noises (in particular, common mode noises). It is possible to accurately input the signal into the drive signal generation circuit.

In the first cable through which the drive signal generation control signal is transmitted, it is possible to further reduce an effect of external noises (in particular, mutual interference) on the drive signal generation control signal by a constant electric potential, such as a ground electric potential and a power supply electric potential, surrounding the perimeter of the wiring (core wire) through which the drive signal generation control signal that is a differential signal is transmitted. Thus, the drive signal generation control signal is accurately input into the drive signal generation circuit. Therefore, there is a possibility that the accuracy of the drive signal output from the drive signal generation circuit improves.

Application Example 8

In the liquid discharging apparatus according to the application example, a state detection circuit that is mounted on the carriage, detects a state of the print head, and generates a state signal, which is an analog signal indicating the state of the print head, a conversion circuit that is provided on the drive circuit substrate and converts the state signal to a digital signal, a third cable through which the state signal is transmitted from the state detection circuit to the conversion circuit, and a fourth cable through which the state signal converted to the digital signal is transmitted from the conversion circuit to the control signal generation circuit may be further included.

In the liquid discharging apparatus according to the application example, the state signal indicating the state of the print head is transmitted to the control circuit substrate after being converted to a digital signal in the drive circuit substrate. The signal indicating the state of the print head includes an analog signal indicating temperature information or characteristics of the nozzle, such as a residual vibration signal. An effect of external noises caused by wiring is reduced by converting the state signal to a digital signal in the drive circuit substrate provided between the print head and the control circuit substrate. For this reason, the state of the print head is accurately transmitted to the control circuit substrate. Accordingly, it is possible for the control signal generation circuit to output an appropriate drive signal generation control signal to the drive signal generation circuit according to the state of the print head. Thus, the drive signal generation control signal is optimally corrected and is accurately input into the drive signal generation circuit. Therefore, there is a possibility that the accuracy of the drive signal input from the drive signal generation circuit improves.

Application Example 9

In the liquid discharging apparatus according to the application example, the print head may discharge the liquid at a frequency of 30 kHz or higher.

The occurrence of overshoot or undershoot is likely to increase since a change in the voltage of the drive signal becomes steeper as a frequency at which a liquid is discharged becomes higher (as a speed at which printing is performed increases). In the liquid discharging apparatus according to the application example, the effect described above is even larger since high-speed printing is performed at a frequency of 30 kHz or higher at which, in particular, the occurrence of overshoot or undershoot of the drive signal is likely to increase.

BRIEF DESCRIPTION OF THE DRAWINGS

The invention will be described with reference to the accompanying drawings, wherein like numbers reference like elements.

FIG. 19 is a diagram showing a configuration of a cable provided between the head unit and the drive substrate in the embodiment.

FIG. 20 is a diagram showing a configuration of a cable provided between the drive substrate and the control substrate in the embodiment.

DESCRIPTION OF EXEMPLARY EMBODIMENTS

Hereinafter, a suitable embodiment of the invention will be described in detail with reference to the drawings. The referred drawings are for the convenience of description. The embodiment to be described below does not wrongfully limit the content of the invention described in the scope of claims. Not all configurations described below are essential configuration requirements.

1. Outline of Liquid Discharging Apparatus

A printing apparatus, which is an example of a liquid discharging apparatus according to the embodiment, is an ink jet printer that forms ink dot groups onto a printing medium, such as paper, by discharging inks according to image data supplied from an external host computer and thereby prints an image (including characters and figures) corresponding to the image data.

Figure 1:
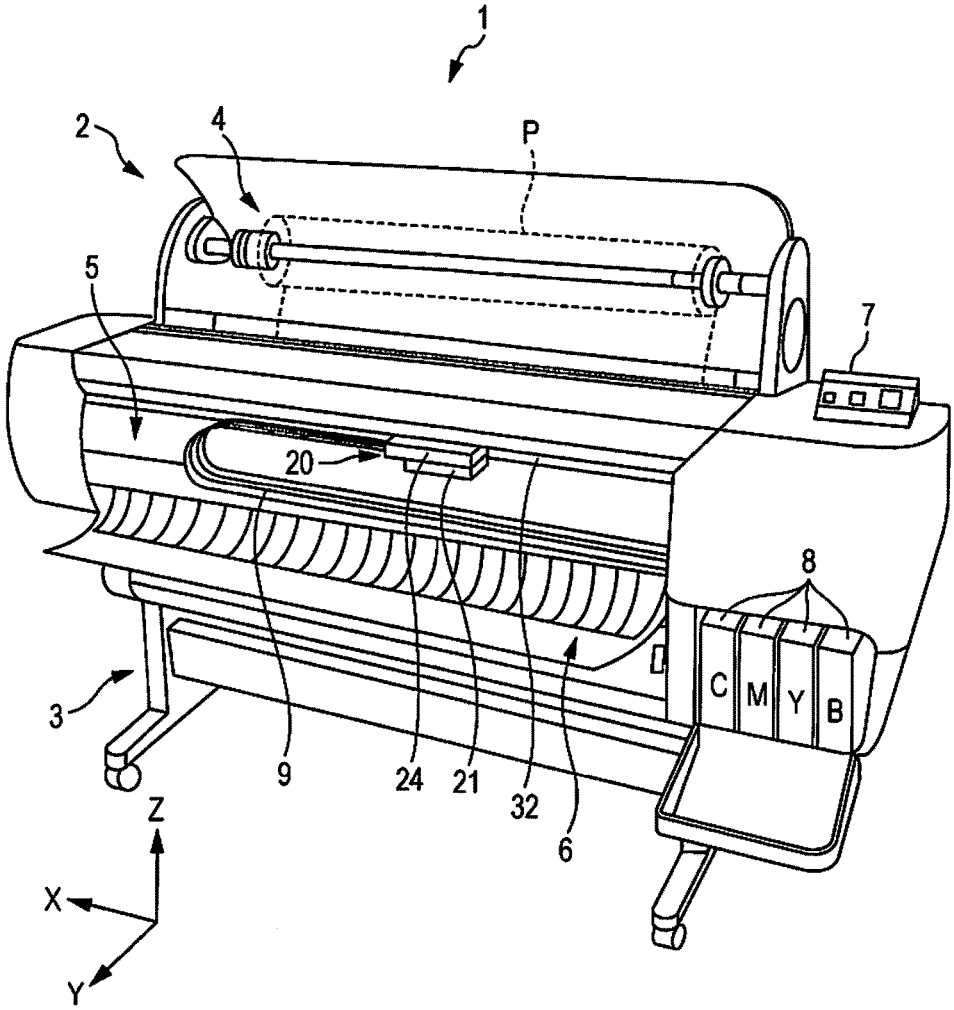
FIG. 1 is a schematic view illustrating an appearance of a liquid discharging apparatus.

FIG. 1 is a schematic view illustrating an appearance of a liquid discharging apparatus 1. As illustrated in FIG. 1, the liquid discharging apparatus 1 is a serial scan type (serial printing type) large format printer, and includes a main body 2 and a support stand 3 that supports the main body 2. The large format printer is, for example, a printer that corresponds to the size of paper having an A3 short side width (297 mm×420 mm) or longer, which is a printable size of a printing medium, and the large format printer in the embodiment is a so-called large format printer (LFP) of which maximum printable size of a printing medium P is approximately 70 inches. In the embodiment, in FIG. 1, a moving direction of a carriage 24 of the liquid discharging apparatus 1 will be referred to as a main scanning direction X, a transporting direction of the printing medium P of the liquid discharging apparatus 1 will be referred to as a sub-scanning direction Y, and a vertical direction of the liquid discharging apparatus 1 will be referred to as a vertical direction Z. Although the main scanning direction X, the sub-scanning direction Y, and the vertical direction Z are illustrated as three axes of X, Y, and Z, which are orthogonal to each other, in the drawings, a disposition relationship of each unit is not necessarily limited to being orthogonal to each other.

As illustrated in FIG. 1, the main body 2 includes a supplying unit 4 that supplies the printing medium (rolled paper) P (an example of a "medium"), a printing unit 5 that discharges ink droplets onto the printing medium P to perform printing onto the printing medium P, a sending-out unit 6 that sends the printing medium P printed by the printing unit 5 out from the main body 2, an operation unit 7 that performs operation of execution and stop of printing, and an ink storing unit 8 that stores an ink (liquid) to be discharged. Although not illustrated, a USB port and a power supply port are provided in the rear surface of the liquid discharging apparatus 1. That is, the liquid discharging apparatus 1 is configured so as to be connectable to a computer via a USB port.

The printing unit 5 is configured so as to include a head unit 20, a carriage guide shaft 32, and an ink tube 9.

The head unit 20 (an example of a "print head") includes the carriage 24 and a head 21 that is mounted on the carriage 24 so as to oppose the printing medium (rolled paper) P. The head 21 is a liquid ejecting head for discharging ink droplets (liquid droplets) from multiple nozzles. In addition, the carriage 24 is supported by the carriage guide shaft 32 and moves (reciprocates) in the main scanning direction X. At this time, the printing medium P is transported in the sub-scanning direction Y. That is, the liquid discharging apparatus 1 in the embodiment performs serial printing, in which the head unit 20, including the carriage 24 on which the head 21 discharging ink droplets (liquid) is mounted, moves (reciprocates) and prints in the main scanning direction X.

A plurality of ink cartridges 22 are attached to the ink storing unit 8, and each of the ink cartridges 22 is filled with an ink having a corresponding color. Although the four ink cartridges 22 corresponding to four colors such as cyan (C), magenta (M), yellow (Y), and black (B) are illustrated in FIG. 1, the ink cartridges 22 are not limited to this configuration. For example, four or more ink cartridges 22 may be included, or the ink cartridges 22 for different colors such as gray, green, and violet may be included. An ink accommodated in each of the ink cartridges 22 is supplied to the head 21 via the ink tube 9.

2. Electrical Configuration of Liquid Discharging Apparatus

Figure 2:
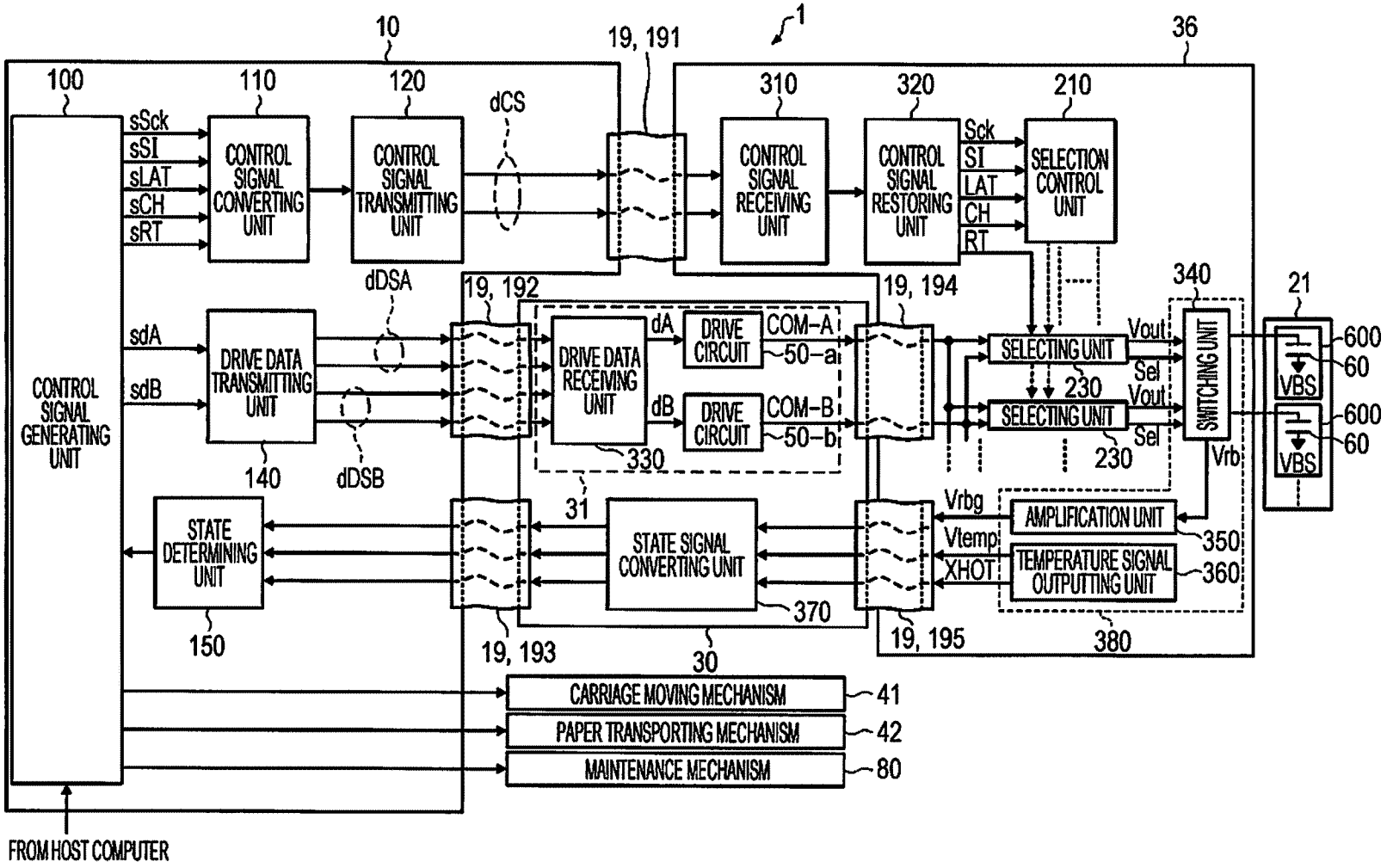
FIG. 2 is a block diagram showing an electrical configuration of the liquid discharging apparatus.

FIG. 2 is a block diagram showing an electrical configuration of the liquid discharging apparatus 1 of the embodiment.

As shown in FIG. 2, the liquid discharging apparatus 1 includes a control substrate 10 that controls discharging of a liquid, the head 21 that has discharging units 600 which discharge liquids, a drive substrate 30 that generates a drive signal, a head substrate 36 that generates a selection signal for selecting a drive signal to be output to the head 21, and a plurality of cables 19 connecting these configurations together. Although the liquid discharging apparatus 1 may be configured so as to include a plurality of heads 21, one head 21 represents the plurality of heads in FIG. 2.

A control signal generating unit 100, a control signal converting unit 110, a control signal transmitting unit 120, a drive data transmitting unit 140, and a state determining unit 150 are provided (mounted) in the control substrate 10.

The control signal generating unit 100 (an example of a "control signal generation circuit") outputs various types of control signals for controlling each unit when various types of signals, such as image data, are supplied from the host computer. Specifically, the control signal generating unit 100 generates a control signal for controlling a carriage moving mechanism 41 and a control signal for controlling a paper transporting mechanism 42. The carriage moving mechanism 41 moves (reciprocates) the carriage 24 in the main scanning direction X, for example, by controlling the rotation of a motor for moving the carriage 24. In addition, the paper transporting mechanism 42 supports, for example, the continuous printing medium P, which is wound in a roll shape, so as to be rotatable, and transports the printing medium P by rotation. That is, by the carriage moving mechanism 41 and the paper transporting mechanism 42 operating based on control signals from the control signal generating unit 100, it is possible to perform printing at a predetermined position on the printing medium P.

The control signal generating unit 100 generates a control signal for causing a maintenance mechanism 80 to execute maintenance processing for returning ink discharge states of the discharging units 600 to normal. Based on the control signal from the control signal generating unit 100, the maintenance mechanism 80 performs cleaning processing (pumping processing), in which thickened inks and bubbles in the discharging units 600 are suctioned by a tube pump (not illustrated), and wiping processing, in which foreign substances, such as paper dust stuck around nozzles of the discharging units 600, are wiped off by a wiper, as maintenance processing.

The control signal generating unit 100 generates an original clock signal sSck, an original print data signal sSI, an original latch signal sLAT, an original change signal sCH, and an original switching period designation signal sRT based on various types of signals from the host computer, as a plurality of types of original control signals for controlling the discharging of liquids from the discharging units 600, and outputs the signals to the control signal converting unit 110 in a parallel format. In the plurality of types of original control signals, some of the signals may not be included, or other signals may be included.

In addition, the control signal generating unit 100 generates original drive data pieces sdA and sdB, which are data pieces indicating drive signals for driving the discharging units 600 included in the head 21, based on various types of signals from the host computer, and outputs the data pieces to the drive data transmitting unit 140 in a parallel format. For example, the original drive data pieces sdA and sdB may be digital data pieces obtained by converting the waveforms (drive waveforms) of drive signals from analog to digital, may be digital data pieces that define a corresponding relationship between a length and a slope of each section where a slope is constant in a drive waveform, or may be digital data pieces in which one of a plurality of types of drive waveforms stored in a memory unit (not illustrated) is selected.

The control signal converting unit 110 converts (serializes) the plurality of types of original control signals (the original clock signal sSck, the original print data signal sSI, the original latch signal sLAT, the original change signal sCH, and the original switching period designation signal sRT) output from the control signal generating unit 100 to a serial control signal in one serial format, and outputs the signal to the control signal transmitting unit 120. The control signal converting unit 110 generates a clock signal for transmission used in high-speed serial data transmission via the cable 19, and incorporates the clock signal for transmission into the serial control signal along with the plurality of types of original control signals.

The control signal transmitting unit 120 converts the serial control signal output from the control signal converting unit 110 to original control differential signals dCS, and transmits the signals to the head substrate 36 via the cable 19. The cable 19 through which the original control differential signals dCS output from the control signal transmitting unit 120 are transmitted will be referred to as an FFC 191.

For example, the control signal transmitting unit 120 converts the serial control signal to differential signals in a low voltage differential signaling (LVDS) transmission mode and outputs the signals to the head substrate 36. Since the amplitudes of the differential signals in the LVDS transmission mode are approximately 350 mV, high-speed data transmission can be realized. The control signal transmitting unit 120 may transmit differential signals in various types of high-speed transmission modes other than LVDS, such as low voltage positive emitter coupled logic (LVPECL) and current mode logic (CML), to the head substrate 36. The control signal transmitting unit 120 may independently transmit a clock signal for transmission to the head substrate 36 without the control signal converting unit 110 incorporating the clock signal for transmission into a serial control signal.

The drive data transmitting unit 140 converts the original drive data pieces sdA and sdB output from the control signal generating unit 100 to original drive differential signals dDSA and dDSB (examples of a "drive signal generation control signal") in a serial format, respectively, and transmits the data to the drive substrate 30 via the cable 19. The cable 19 through which the original drive differential signals dDSA and dDSB output from the drive data transmitting unit 140 included in the control substrate 10 are transmitted will be referred to as an FFC 192 (an example of a "first cable").

For example, the original drive differential signals dDSA and dDSB output from the drive data transmitting unit 140 are digital signals. Specifically, the drive data transmitting unit 140 may convert each of the original drive data pieces sdA and sdB to a differential signal in a high-speed transmission mode such as LVDS and transmit the signals to the head substrate 36. The drive data transmitting unit 140 may serialize the original drive data pieces sdA and sdB to one serial signal in a serial format, and convert the serial signal to the original drive differential signals dDSA and dDSB to transmit the signals to the head substrate 36. The drive data transmitting unit 140 may incorporate a clock signal for transmission used in high-speed serial data transmission into a differential signal, or may independently transmit the clock signal for transmission to the head substrate 36.

The state determining unit 150 determines the states of the discharging units 600 based on digital state signals input via the cable 19. A state signal is a signal indicating the state of the head 21, may be, for example, a residual vibration signal Vrbg indicating residual vibration of the discharging units 600 after piezoelectric elements 60 (examples of a "driving element") included in the discharging units 600 of the head 21 are driven, or may be a temperature signal Vtemp indicating the temperature of the head 21. A state signal may be an abnormality signal XHOT indicating an abnormality (abnormal temperature) of the head 21. There may be a plurality of state signals including the residual vibration signal Vrbg, the temperature signal Vtemp, and the abnormality signal XHOT, or a state signal may be any one of the signals. The cable 19 through which a state signal is transmitted will be referred to as an FFC 193 (an example of a "fourth cable"). A state signal is not limited to the signals described above. For example, the state signal may be a signal indicating that a current supplied to the head 21 is detected and a signal indicating that the amplitude of a voltage of a drive signal is detected. The state determining unit 150 may be configured so as to be included in the control signal generating unit 100.

The control signal generating unit 100 also performs processing according to determination results of the state determining unit 150. For example, in a case where the state determining unit 150 determines that there is a discharge failure, the control signal generating unit 100 may generate a control signal for the maintenance mechanism 80 to execute maintenance processing. In addition, for example, in a case where the state determining unit 150 determines that the internal temperature of the head 21 exceeds a predetermined level (temperature is excessively high), the control signal generating unit 100 may generate original control signals (the original clock signal sSck, the original print data signal sSI, the original latch signal SLAT, the original change signal sCH, and the original switching period designation signal sRT) for slowing down the speed of printing or discontinuing printing. For example, when it is determined that the head 21 is abnormal, the operation of the liquid discharging apparatus 1 may be stopped.

A drive signal generating unit 31 and a state signal converting unit 370 are provided (mounted) on the drive substrate 30.

The drive signal generating unit 31 (an example of a "drive signal generation circuit") is configured so as to include a drive data receiving unit 330 and drive circuits 50-*a* and 50-*b*.

The drive data receiving unit 330 receives the original drive differential signals dDSA and dDSB transmitted from the control substrate 10, and outputs drive data pieces dA and dB, which are data pieces indicating drive signals for driving the discharging units 600 provided in the head 21. Specifically, the drive data receiving unit 330 differential-amplifies the received original drive differential signals dDSA and dDSB, restores a clock signal for transmission incorporated in the differential-amplified signal, and outputs the drive data pieces dA and dB in a parallel format by restoring the original drive data pieces sdA and sdB included in the differential-amplified signal based on the clock signal for transmission.

The drive circuits 50-*a* and 50-*b* generate drive signals COM-A and COM-B (examples of a "drive signal") for driving each of the discharging units 600 provided in the head 21 based on the drive data pieces dA and dB output from the drive data receiving unit 330.

For example, if the drive data pieces dA and dB are digital data pieces obtained by converting the waveforms of the drive signals COM-A and COM-B, respectively, from analog to digital, the drive circuits 50-*a* and 50-*b* generate analog signals obtained by converting the drive data pieces dA and dB, respectively, from digital to analog, and after then, amplify the signals with a class D amplifier to generate the drive signals COM-A and COM-B.

For example, if each of the drive data pieces dA and dB is digital data that defines a corresponding relationship between a length and a slope of each section of which slope is constant in each of the waveforms of the drive signals COM-A and COM-B, each of the drive circuits 50-*a* and 50-*b* generates an analog signal that satisfies the corresponding relationship between a length and a slop of each section defined by each of the drive data pieces dA and dB and amplifies the signal with a class D amplifier to generate the drive signals COM-A and COM-B.

For example, if each of the drive data pieces dA and dB is digital data in which one of a plurality of types of drive waveforms stored in the memory unit (not illustrated) is selected, each of the drive circuits 50-*a* and 50-*b* generates an analog signal selected in each of the read drive data pieces dA and dB and amplifies the signal with a class D amplifier to generate the drive signals COM-A and COM-B.

As described above, the drive data pieces dA and dB are data pieces defining the waveforms of the drive signals COM-A and COM-B, respectively. The drive signals COM-A and COM-B generated by the drive circuits 50-*a* and 50-*b* are transmitted to the head substrate 36 via the cable 19. The cable 19 through which the drive signals COM-A and COM-B are transmitted to the head substrate 36 will be referred to as an FFC 194 (an example of a "second cable"). The drive circuits 50-*a* and 50-*b* are different only in terms of data to be input and a drive signal to be output, and may have the same circuit configuration. Although the plurality of drive circuits 50-*a* and 50-*b* may be mounted on the drive substrate 30, a pair of drive circuits 50-*a* and 50-*b* represents the plurality of drive circuits in FIG. 2.

The state signal converting unit 370 (an example of a "conversion circuit") converts each of the residual vibration signal Vrbg, the temperature signal Vtemp, and the abnormality signal XHOT, which are input from the head substrate 36 via the cable 19 as state signals, to a digital signal. By converting the state signals to digital signals in the drive substrate 30, it is possible to reduce an effect of external noises during transmission and the detection sensitivity of the state of the head 21 can be enhanced. Accordingly, it is possible to accurately detect the state of the head 21 and the accuracy of discharging ink droplets can be improved, in the control substrate 10. The state signals converted to the digital signals are transmitted to the state determining unit 150 via an FFC 193. The cable 19 through which the state signals are transmitted to the state signal converting unit 370 will be referred to as an FFC 195 (an example of a "third cable").

The abnormality signal XHOT is a signal, in which a temperature abnormality of the head 21 is detected, and it is necessary for the signal to be promptly transmitted to the control substrate 10. For this reason, the abnormality signal XHOT may have, for example, two values (that is, a digital signal) of "abnormality" and "normality", or may be input into the state determining unit 150 without going through the state signal converting unit 370.

A control signal receiving unit 310, a control signal restoring unit 320, a selection control unit 210, a plurality of selecting units 230, a switching unit 340, an amplification unit 350, and a temperature signal outputting unit 360 are provided (mounted) on the head substrate 36. The head 21 including the discharging units 600 is connected to the head substrate 36.

The control signal receiving unit 310 receives the original control differential signals dCS transmitted from the control substrate 10 via the FFC 191 and converts the received original control differential signals dCS to a serial control signal to output to the control signal restoring unit 320. Specifically, the control signal receiving unit 310 may receive differential signals in the LVDS transmission mode and differential-amplify the differential signals to convert to a serial control signal.

The control signal restoring unit 320 generates a plurality of types of control signals (a clock signal Sck, a print data signal SI, a latch signal LAT, a change signal CH, and a switching period designation signal RT) for controlling the discharging of liquids from the discharging units 600 included in the head 21 based on the serial control signal converted by the control signal receiving unit 310. Specifically, the control signal restoring unit 320 restores the clock signal for transmission incorporated in the serial control signal output from the control signal receiving unit 310, and restores (deserializes) the plurality of types of original control signals (the original clock signal sSck, the original print data signal sSI, the original latch signal sLAT, the original change signal sCH, and the original switching period designation signal sRT) included in the serial control signal based on the clock signal for transmission to generate the plurality of types of control signals (the clock signal Sck, the print data signal SI, the latch signal LAT, the change signal CH, and the switching period designation signal RT) in a parallel format.

The selection control unit 210 instructs each of the selecting units 230 whether or not to select the drive signal COM-A by mean of the plurality of types of control signals (the clock signal Sck, the print data signal SI, the latch signal LAT, and the change signal CH) output from the control signal generating unit 100.

Each of the selecting units 230 selects from the drive signals COM-A and COM-B in accordance with an instruction from the selection control unit 210, and outputs the signal to the switching unit 340 as a drive signal Vout. The drive signal COM-A is a signal for driving each of the discharging units 600 of the head 21 to discharge liquids, and the drive signal COM-B is a signal for inspecting for a discharge failure of each of the discharging units 600 of the head 21.

Each of the selecting units 230 generates a selection signal Sel based on the switching period designation signal RT output from the control signal restoring unit 320 and outputs the signal to the switching unit 340. In the embodiment, the selection signal Sel is a signal that comes at a high level only when the switching period designation signal RT is at a high level and the drive signal COM-B is selected.

The switching unit 340 controls the drive signal Vout so as to be applied to one end of each of the piezoelectric elements 60 of the corresponding discharging units 600 of the head 21 when the selection signal Sel output from each of the selecting units 230 is at a low level, and controls the drive signal Vout so as not to be applied to one end of each of the piezoelectric elements 60 when the selection signal Sel is at a high level. A voltage VBS is commonly applied to the other end of each of the piezoelectric elements 60 of the head 21. The piezoelectric elements 60 are displaced when drive signals are applied thereto. Each of the piezoelectric elements 60 is provided so as to correspond to each of the plurality of discharging units 600 in the head 21. The piezoelectric elements 60 are displaced according to a potential difference between the drive signal Vout and the voltage VBS to discharge inks.

In the embodiment, the switching period designation signal RT is at a low level at all times during printing, and repeatedly comes at a low level and a high level in a periodic manner during inspection. That is, the drive signal Vout is applied to all of the discharging units 600 at all times during printing. During inspection, the drive signal Vout is applied to each of the discharging units 600 (the discharging units 600 corresponding to the selecting units 230, which have not selected the drive signal COM-B as the drive signal Vout), which are non-inspection targets, at all times. However, the drive signal Vout is not applied to each of the discharging units 600 (the discharging units 600 corresponding to the selecting units 230, which have selected the drive signal COM-B as the drive signal Vout), which are inspection targets, for a certain length of time after the drive signal Vout is applied. A signal that appears at one end of each of the piezoelectric elements 60 of the discharging units 600 for this certain length of time is output from the switching unit 340 as a residual vibration signal Vrb.

The amplification unit 350 generates the residual vibration signal Vrbg, which is obtained by amplifying the residual vibration signal Vrb, as one of state signals indicating the state of the head unit 20 and outputs the signal to the state signal converting unit 370 provided in the drive substrate 30.

The temperature signal outputting unit 360 outputs the temperature of the head substrate 36 and the temperature of the head 21, which are detected by a temperature sensor (not illustrated), as a state signal indicating the state of the head substrate 36 and the state of the head 21. The temperature signal outputting unit generates the temperature signal Vtemp indicating the temperature of the head 21 as one of state signals indicating the state of the head substrate 36 and the state of the head 21, and outputs the signal to the state signal converting unit 370 provided in the drive substrate 30. For example, the temperature sensor may be provided at a position where the sensor can detect any of the temperatures of members, of which temperatures are likely to become high, such as the temperatures of nozzles 651 or nozzle plates 632 (refer to FIG. 3), and the temperatures of transfer gates 234*a* and 234*b* (refer to FIG. 12) of each of the selecting units 230, as the temperature of the head 21. In addition, a plurality of temperature sensors each of which detects the temperature of each of the plurality of members, of which temperatures are likely to become high, may be provided.

The switching unit 340, the amplification unit 350, and the temperature signal outputting unit 360 configure a state signal generating unit 380 (an example of a "state detection circuit") which detects the state of the head unit 20 and generates state signals (the residual vibration signal Vrbg and the temperature signal Vtemp).

3. Configuration of Printing Head 3.1 Configuration of Discharging Unit

Figure 3:
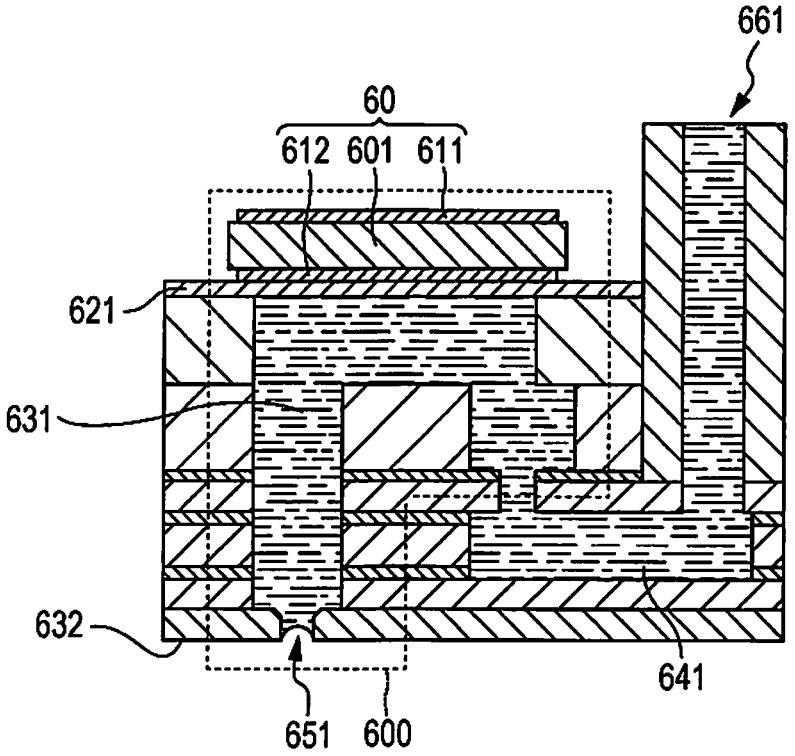
FIG. 3 is a view illustrating a schematic configuration corresponding to one discharging unit of a head.

FIG. 3 is a view illustrating a schematic configuration corresponding to one discharging unit 600 in the head 21. As illustrated in FIG. 3, the head 21 includes the discharging unit 600 and a reservoir 641.

The reservoir 641 is provided for each color of ink, and an ink is introduced from a supply port 661 to the reservoir 641. An ink is supplied from each of the ink cartridges 22 provided in the ink storing unit 8 to the supply port 661 via the ink tube 9.

Each of the discharging units 600 includes the piezoelectric element 60 (an example of a "driving element"), a vibrating plate 621, a cavity (pressure chamber) 631, and the nozzle 651. The vibrating plate 621 is displaced (bending vibration) by the piezoelectric element 60 provided at the top in FIG. 3, and functions as a diaphragm that increases/decreases the internal volume of the cavity 631 filled with an ink. The nozzle 651 is provided in the nozzle plate 632 and is an opening portion that communicates with the cavity 631. The cavity 631 is filled with a liquid (for example, an ink), and the internal volume of the cavity changes due to the displacement of the piezoelectric element 60. The nozzle 651 communicates with the cavity 631 and discharges the liquid in the cavity 631 as liquid droplets according to the change in the internal volume of the cavity 631.

The piezoelectric element 60 illustrated in FIG. 3 has a structure in which a piezoelectric body 601 is sandwiched between a pair of electrodes 611 and 612. A middle portion of the piezoelectric body 601 having this structure bends in an up-and-down direction with the electrodes 611 and 612 and the vibrating plate 621 with respect to both end portions in FIG. 3 according to a voltage applied by the electrodes 611 and 612. Specifically, when the voltage of the drive signal Vout becomes higher, the piezoelectric element 60 bends upwards, and when the voltage of the drive signal Vout becomes lower, the piezoelectric element bends downwards. In this configuration, since the internal volume of the cavity 631 increases when the piezoelectric element bends upwards, an ink is drawn into the reservoir 641. On the other hand, since the internal volume of the cavity 631 decreases when the piezoelectric element bends downwards, an ink is discharged from the nozzle 651 depending on the degree of decrease.

Without being limited to the illustrated structure, each of the piezoelectric elements 60 may be in any form in which the piezoelectric element 60 is deformed and a liquid such as an ink can be discharged. In addition, without being limited to bending vibration, each of the piezoelectric elements 60 may have a configuration where a so-called longitudinal vibration is used.

In addition, each of the piezoelectric elements 60 is provided so as to correspond to the cavity 631 and the nozzle 651 in the head 21, and is provided so as to correspond to the selecting unit 230 as well. For this reason, a set of the piezoelectric element 60, the cavity 631, the nozzle 651, and the selecting unit 230 is provided for each nozzle 651.

3.2 Relationship between Discharge Failure of Discharging Unit and Residual Vibration There is a case where ink droplets are not discharged normally from the nozzle 651, that is, a case where a discharge failure occurs regardless of the fact that the discharging unit 600 has performed operation for discharging ink droplets. Causes of the occurrence of the discharge failure include (1) bubbles being mixed into the cavity 631, (2) thickening or fixation of an ink in the cavity 631 attributable to the drying of the ink in the cavity 631, and (3) foreign substances, such as paper dust, stuck to the vicinity of an outlet of the nozzle 651.

First, in a case where bubbles are mixed into the cavity 631, the total weight of an ink that fills the cavity 631 reduces. Thus, it is considered that inertance declines. In addition, in a case where bubbles have stuck to the vicinity of the nozzle 651, it is regarded that the diameter of the nozzle 651 becomes longer by the length of the diameter of bubbles. Thus, it is considered that acoustic resistance declines. For this reason, in a case where bubbles are mixed into the cavity 631 and a discharge failure occurs, the frequency of residual vibration becomes higher compared to a case where a discharge state is normal. In addition, the attenuation rate of an amplitude of residual vibration becomes lower due to a decline in acoustic resistance.

Next, in a case where an ink in the vicinity of the nozzle 651 is dried and fixed, the ink in the cavity 631 is locked up in the cavity 631. In such a case, it is considered that acoustic resistance increases. For this reason, in a case where an ink in the vicinity of the nozzle 651 in the cavity 631 is fixed, the frequency of residual vibration becomes extremely lower and residual vibration is excessively attenuated compared to a case where a discharge state is normal.

Next, in a case where foreign substances, such as paper dust, have stuck to the vicinity of the outlet of the nozzle 651, an ink leaks out from the cavity 631 via the foreign substances, such as paper dust. Thus, it is considered that inertance increases. In addition, it is considered that acoustic resistance increases due to fiber of paper dust stuck to the vicinity of the outlet of the nozzle 651. For this reason, in a case where foreign substances, such as paper dust, have stuck to the vicinity of the outlet of the nozzle 651, the frequency of residual vibration becomes lower compared to a case where a discharge state is normal.

The state determining unit 150 can determine the presence or absence of a discharge failure based on the frequency of the residual vibration signal Vrbg and the attenuation rate (attenuated time) of an amplitude.

3.3 Configuration of Drive Signal

Figure 4:
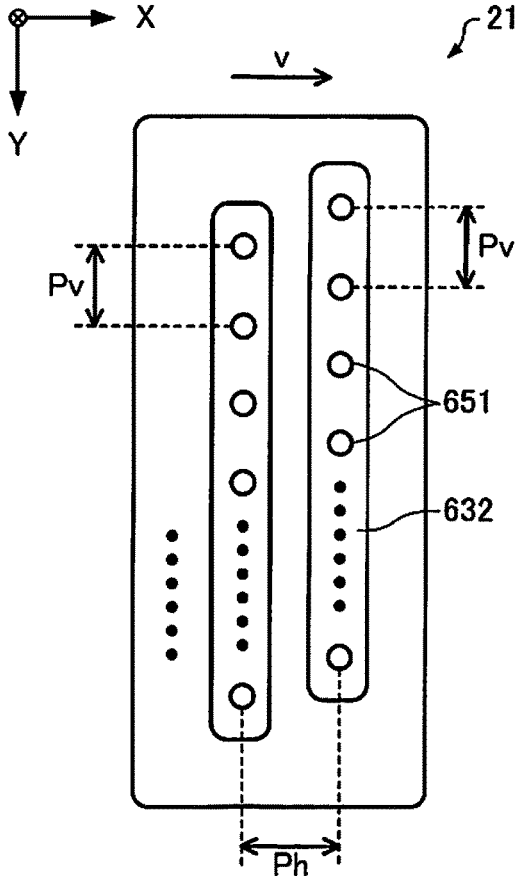
FIG. 4 is a view illustrating an example of array of nozzles.

FIG. 4 is a view illustrating an example of the array of the nozzles 651. As illustrated in FIG. 4, the nozzles 651 are arrayed, for example, in two rows, as follows. Specifically, as for nozzles in one row, the plurality of nozzles 651 are disposed at a pitch Pv in the sub-scanning direction Y. Two rows of nozzles are spaced away from one another row at a pitch Ph in the main scanning direction X. The first row nozzle and the second row nozzle are in a relationship of being shifted away from each other at half the pitch Pv in the sub-scanning direction Y.

Although the nozzles 651 are provided in a pattern corresponding to each color of the ink cartridges 22 to be used (for example, cyan (C), magenta (M), yellow (Y), and black (B)), for example, in the main scanning direction X, a case where gradations are expressed with a single color will be described to simplify the following description.

Figure 5:
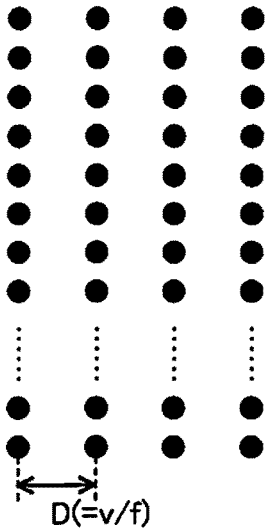
FIG. 5 is a view for illustrating basic resolution of image formation by nozzle array.

FIG. 5 is a view for illustrating basic resolution of image formation by the nozzle array illustrated in FIG. 4. To simplify description, FIG. 5 is an example of a method (first method), in which the nozzles 651 discharge ink droplets one time to form one dot, and black circles indicate dots formed by landing of ink droplets.

When the head unit 20 moves in the main scanning direction X at a speed v, a dot interval D (in the main scanning direction X) between dots formed by landing of ink droplets as illustrated in FIG. 5 and the speed v are in a relationship as follows.

That is, in a case where one dot is formed by one time of discharging of ink droplets, the dot interval D is a value (=v/f) obtained by dividing the speed v by an ink discharge frequency f, in other words, is a distance by which the head unit 20 moves in a period (1/f) when ink droplets are repeatedly discharged.

In examples illustrated in FIGS. 4 and 5, a relationship of the pitch Ph being proportional to the dot interval D by a coefficient n is established, such that ink droplets discharged by the two rows of nozzles 651 land in the same rows on the printing medium P. For this reason, as illustrated in FIG. 5, a dot interval in the sub-scanning direction Y is half a dot interval in the main scanning direction X. The array of dots is not limited to the illustrated example.

High-speed printing is realized simply by increasing the speed v at which the head unit 20 moves in the main scanning direction X. However, simply increasing the speed v makes the dot interval D longer. For this reason, it is necessary to increase the number of dots formed per unit time by increasing the ink discharge frequency f in order to realize high-speed printing with a certain degree of resolution being ensured.

Apart from a printing speed, the number of dots formed per unit area may be increased in order to increase resolution. However, in a case of increasing the number of dots, dots adjacent to each other combine together if the used amount of ink is not small, and a printing speed declines if the ink discharge frequency f is not increased.

As described above, it is necessary to increase the ink discharge frequency f in order to realize high-speed printing and high-resolution printing. The liquid discharging apparatus 1 in the embodiment is a large format printer, and it is preferable to discharge a liquid at a frequency of 30 kHz or higher in order to execute high-speed printing and high-resolution printing.

In addition to a method of forming one dot by discharging ink droplets one time, there are a method of forming one dot (second method) by discharging ink droplets two or more times per unit time, landing one or more ink droplets discharged per unit time, and combining one or more landed ink droplets and a method of forming two or more dots (third method) without combining the two or more ink droplets, as a method of forming a dot onto the printing medium P. In the embodiment, according to the second method, four gradations of a "large dot", a "medium dot", a "small dot", and a "non-recording (no dot)" are expressed for one dot by discharging an ink two times at maximum.

To express the four gradations, the drive signal COM-A has the former half pattern and the latter half pattern in one period of dot formation in the embodiment. A configuration where whether or not to supply the drive signal COM-A to each of the piezoelectric elements 60 in the former half and the latter half of one period is selected (or not selected) according to a gradation to be expressed. In the embodiment, the drive signal COM-B is prepared as well to generate the drive signal Vout corresponding to "inspection".

Figure 6:
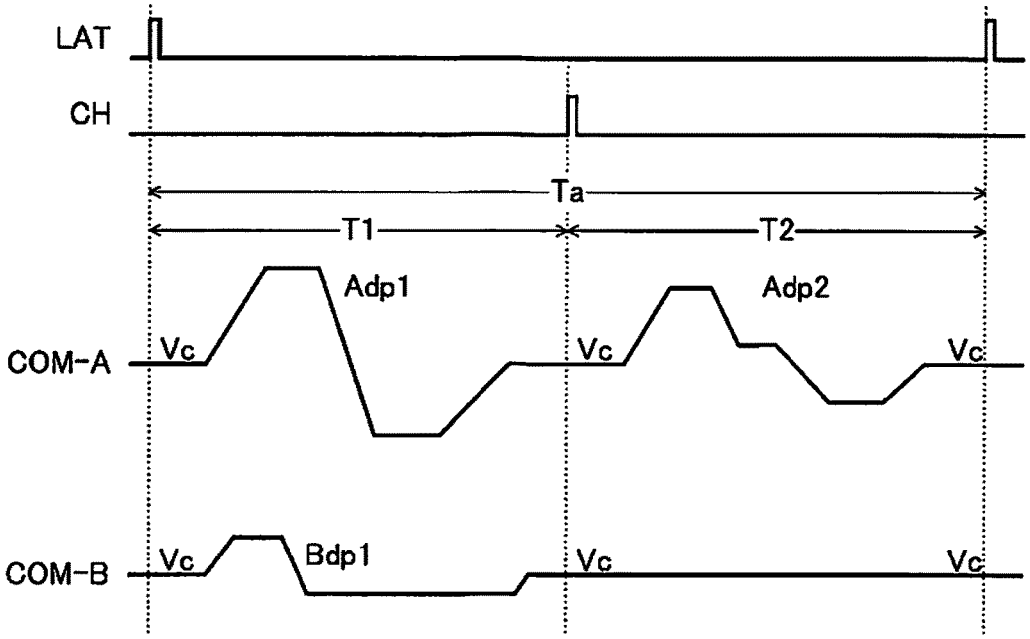
FIG. 6 is a diagram showing waveforms of drive signals.

FIG. 6 is a diagram showing the waveforms of the drive signals COM-A and COM-B. As shown in FIG. 6, the drive signal COM-A has a waveform, in which a trapezoidal waveform Adp1 disposed in a period T1 from the rise of the latch signal LAT to the rise of the change signal CH is followed by a trapezoidal waveform Adp2 disposed in a period T2 from the rise of the change signal CH to the next rise of the latch signal LAT. A period formed of the period T1 and period T2 is set as a period Ta, and a new dot is formed onto the printing medium P for each period Ta.

In the embodiment, the trapezoidal waveforms Adp1 and Adp2 are waveforms that are different from each other. In particular, the trapezoidal waveform Adp1 is a waveform in which the nozzle 651 corresponding to the piezoelectric element 60 is caused to discharge a predetermined amount, specifically, a medium amount of ink. The trapezoidal waveform Adp2 is a waveform that is different from the trapezoidal waveform Adp1. The trapezoidal waveform Adp2 is a waveform in which a smaller amount of ink than the predetermined amount described above is discharged from the nozzle 651 corresponding to the piezoelectric element 60 when a drive signal having this waveform is supplied to one end of the piezoelectric element 60.

The drive signal COM-B has a waveform, in which a trapezoidal waveform Bdp1 disposed in the period T1 is followed by a waveform of a constant voltage Vc, which is disposed in the period T2. The trapezoidal waveform Bdp1 is a waveform for vibrating an ink in the vicinity of the opening portion of the nozzle 651 and generating desired residual vibration necessary for inspection. Even when the trapezoidal waveform Bdp1 is supplied to one end of the piezoelectric element 60, an ink is not discharged from the nozzle 651 corresponding to the piezoelectric element 60.

Both of a voltage at a start timing of the trapezoidal waveforms Adp1, Adp2, and Bdp1 and a voltage at an end timing are the same, that is, the voltage Vc. That is, each of the trapezoidal waveforms Adp1, Adp2, and Bdp1 is a waveform that starts with the voltage Vc and ends with the voltage Vc.

Figure 7:
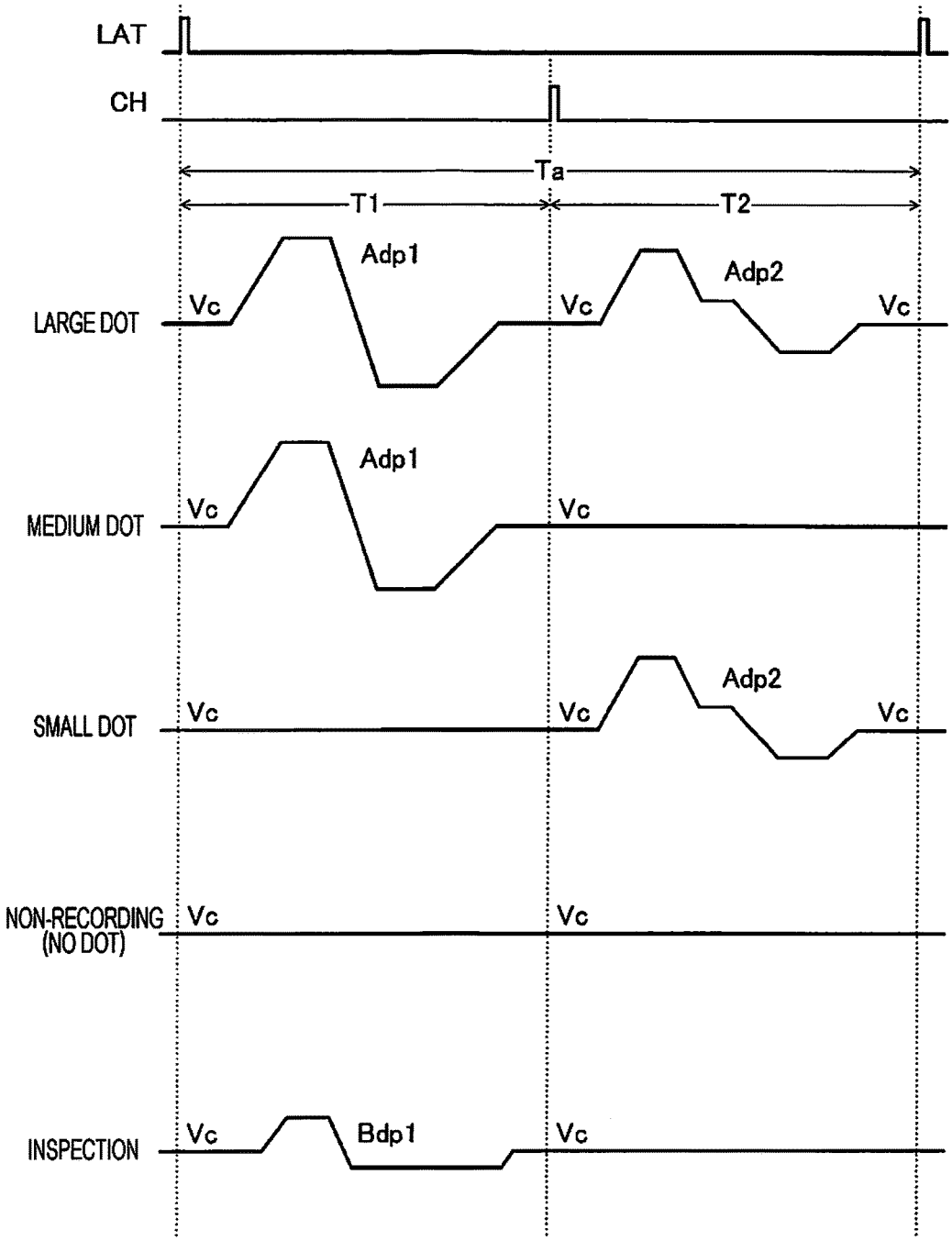
FIG. 7 is a diagram showing the waveforms of the drive signals.

FIG. 7 is a diagram showing a waveform of the drive signal Vout corresponding to each of the "large dot", the "medium dot", the "small dot", the "non-recording", and the "inspection" in the embodiment.

As shown in FIG. 7, the drive signal Vout corresponding to the "large dot" has a waveform, in which the trapezoidal waveform Adp1 of the drive signal COM-A in the period T1 is followed by the trapezoidal waveform Adp2 of the drive signal COM-A in the period T2. When the drive signal Vout is supplied to one end of the piezoelectric element 60, a medium amount of ink is discharged from the nozzle 651 corresponding to the piezoelectric element 60 in the period T1, and a small amount of ink is discharged from the nozzle 651 corresponding to the piezoelectric element 60 in the period T2. For this reason, each ink lands and coalesces to form a large dot on the printing medium P in the period Ta.

The drive signal Vout corresponding to the "medium dot" has a waveform, in which the trapezoidal waveform Adp1 of the drive signal COM-A in the period T1 is followed by the voltage Vc that is a voltage immediately before being held constant due to a capacitive property of the piezoelectric element 60 in the period T2. When the drive signal Vout is supplied to one end of the piezoelectric element 60, a medium amount of ink is discharged one time from the nozzle 651 corresponding to the piezoelectric element 60 in the period Ta. For this reason, a medium dot is formed on the printing medium P in the period Ta.

The drive signal Vout corresponding to the "small dot" has a waveform, in which the voltage Vc that is a voltage immediately before being held constant due to a capacitive property of the piezoelectric element 60 in the period T1 is followed by the trapezoidal waveform Adp2 of the drive signal COM-A in the period T2. When the drive signal Vout is supplied to one end of the piezoelectric element 60, a small amount of ink is discharged one time from the nozzle 651 corresponding to the piezoelectric element 60 in the period Ta. For this reason, a small dot is formed on the printing medium P in the period Ta.

The drive signal Vout corresponding to the "non-recording" has a waveform, in which the voltages Vc that are voltages immediately before being held constant due to a capacitive property of the piezoelectric element 60 follow one after another in the period T1 and the period T2. That is, the piezoelectric element 60 is not driven and an ink is not discharged in the period Ta. For this reason, a dot is not formed on the printing medium P.

The drive signal Vout corresponding to the "inspection" has a waveform, in which the trapezoidal waveform Bdp1 of the drive signal COM-B in the period T1 is followed by the voltage Vc that is a voltage immediately before being held constant due to a capacitive property of the piezoelectric element 60 in the period T2. When the drive signal Vout for inspection is supplied to one end of the piezoelectric element 60, an ink is not discharged although the discharging unit 600 of the piezoelectric element 60 vibrates and residual vibration occurs in the period T1. In the embodiment, the drive signal Vout corresponding to the "non-recording" is applied to all of the discharging units 600 that are not inspection targets.

3.4 Electrical Configuration of Drive Circuit

Operation of the drive circuits 50-*a* and 50-*b* that generate the drive signals COM-A and COM-B will be described. To describe one drive circuit 50-*a*, out of the two drive circuits, the drive signal COM-A is generated as follows. That is, the drive circuit 50-*a*, firstly, converts the drive data dA supplied from the control signal generating unit 100 to analog, secondly, feeds the output drive signal COM-A back and corrects a deviation of a signal (attenuation signal), which is based on the drive signal COM-A, from a target signal, with a high-frequency component of the drive signal COM-A to generate a modulation signal in accordance with the corrected signal, thirdly, generates an amplified modulation signal by switching a transistor in accordance with the modulation signal, and fourthly, smoothes out (demodulates) the amplified modulation signal with a low pass filter to output the smoothed out signal as the drive signal COM-A.

The other drive circuit 50-*b* has the same configuration, and is different only in terms of the fact that the drive signal COM-B is output from the drive data dB. In the following FIG. 8, the drive circuits 50-*a* and 50-*b* will be described as the drive circuit 50 without differentiating between the two drive circuits.

Drive data to be input and a drive signal to be output are expressed with dA (dB) and COM-A (COM-B), respectively. In the case of the drive circuit 50-*a*, it is expressed that the drive data dA is input and the drive signal COM-A is output. In the case of the drive circuit 50-*b*, it is expressed that the drive data dB is input and the drive signal COM-B is output.

Figure 8:
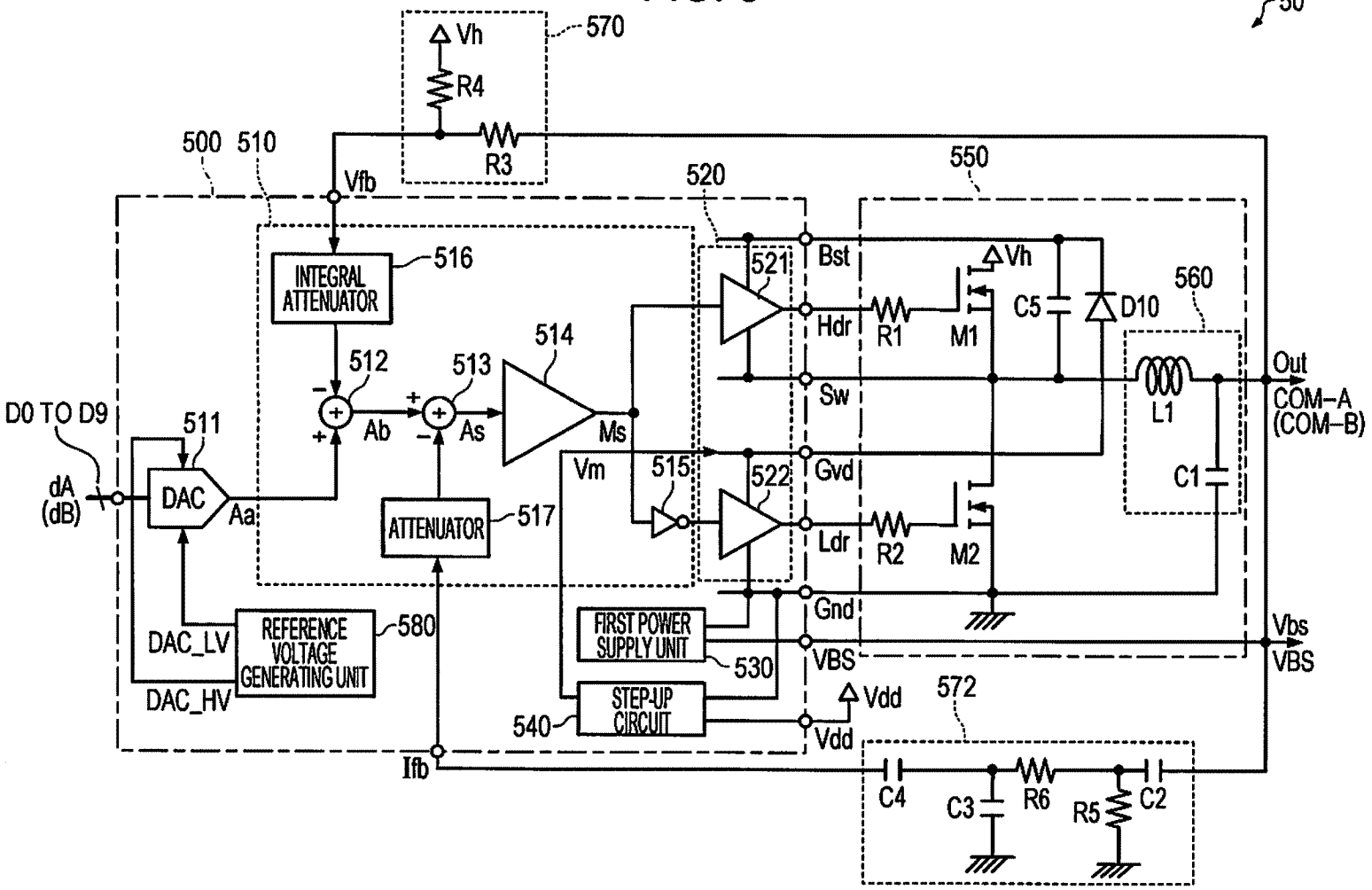
FIG. 8 is a diagram showing a circuit configuration of a drive circuit.

FIG. 8 is a diagram showing a circuit configuration of the drive circuit 50.

Although a configuration for outputting the drive signal COM-A is shown in FIG. 8, an integrated circuit device 500 is, in fact, a circuit in which circuits for generating both of the two drive signals COM-A and COM-B are packaged into one circuit.

As shown in FIG. 8, the drive circuit 50 includes the integrated circuit device 500, an output circuit 550, and various types of elements such as a plurality of resistances and capacitors.

The drive circuit 50 in the embodiment includes a modulating unit 510 that generates a modulation signal obtained by pulse-modulating an original signal, a gate driver 520 that generates an amplified control signal based on the modulation signal, a transistor (a first transistor M1 and a second transistor M2) that generates an amplified modulation signal obtained by amplifying the modulation signal based on the amplified control signal, a low pass filter 560 that demodulates the amplified modulation signal to generate a drive signal, a feedback circuit (a first feedback circuit 570 and a second feedback circuit 572) that feeds the drive signal back to the modulating unit 510, and a step-up circuit 540. In addition, the drive circuit 50 may include a first power supply unit 530 that applies a signal to a terminal, which is different from a terminal to which a drive signal of the piezoelectric element 60 is applied.

The integrated circuit device 500 in the embodiment includes the modulating unit 510 and the gate driver 520.

The integrated circuit device 500 outputs a gate signal (amplified control signal) to each of the first transistor M1 and the second transistor M2 based on the 10-bit drive data dA (original signal) input from the drive data receiving unit 330 via terminals D0 to D9. For this reason, the integrated circuit device 500 includes a digital to analog converter (DAC) 511, an adder 512, an adder 513, a comparator 514, an integral attenuator 516, an attenuator 517, an inverter 515, a first gate driver 521, a second gate driver 522, the first power supply unit 530, the step-up circuit 540, and a reference voltage generating unit 580.

The reference voltage generating unit 580 generates a first reference voltage DAC_HV (reference voltage on a high-voltage side) and a second reference voltage DAC_LV (reference voltage on a low-voltage side), which are regulated by a regulating signal, and supplies the voltages to the DAC 511.

The DAC 511 converts the drive data dA, in which the waveform of the drive signal COM-A is defined, to an underlying drive signal Aa, which is a voltage between the first reference voltage DAC_HV and the second reference voltage DAC_LV, and supplies the signal to an input end (+) of the adder 512. The maximum value and the minimum value of the voltage amplitude of the underlying drive signal Aa are determined by the first reference voltage DAC_HV and the second reference voltage DAC_LV (for example, approximately 1 to 2 V) respectively. When the voltage is amplified, the drive signal COM-A is obtained. That is, the underlying drive signal Aa is a target signal before the amplification of the drive signal COM-A.

The integral attenuator 516 attenuates and integrates a voltage from a terminal Out, which is input via a terminal Vfb, that is, the drive signal COM-A to supply to an input end (−) of the adder 512.

The adder 512 supplies a signal Ab, which is an integrated voltage obtained by deducting a voltage from the input end (−) from a voltage from the input end (+), to an input end (+) of the adder 513.

A power supply voltage of a circuit ranging from the DAC 511 to the inverter 515 is 3.3 V (a voltage VDD supplied from a power supply terminal Vdd) with a low amplitude. For this reason, since there is a case where the voltage of the drive signal COM-A exceeds 40 V at maximum while the voltage of the underlying drive signal Aa is only approximately 2 V at maximum, the voltage of the drive signal COM-A is attenuated by the integral attenuator 516 in order to match amplitude ranges of both voltages when acquiring a deviation.

The attenuator 517 attenuates a high-frequency component of the drive signal COM-A input via a terminal Ifb to supply to an input end (−) of the adder 513. The adder 513 supplies a signal As, which is a voltage obtained by subtracting a voltage from the input end (−) from a voltage from the input end (+), to the comparator 514. As in the integral attenuator 516, attenuation by the attenuator 517 is for matching the amplitudes in feeding back the drive signal COM-A.

The voltage of the signal As output from the adder 513 is a voltage obtained by deducting the attenuation voltage of a signal supplied to the terminal Vfb from the voltage of the underlying drive signal Aa and subtracting the attenuation voltage of a signal supplied to the terminal Ifb. For this reason, the voltage of the signal As output from the adder 513 can be referred to as a signal obtained by correcting a deviation of the attenuation voltage of the drive signal COM-A, which is output from the terminal Out, from the voltage of the underlying drive signal Aa, which is a target, with the high-frequency component of the drive signal COM-A.

Based on a subtraction voltage from the adder 513, the comparator 514 outputs a modulation signal Ms obtained by pulse-modulation as follows. Specifically, the comparator 514 outputs the modulation signal Ms, which is at a level H when the signal As output from the adder 513 is equal to or larger than a voltage threshold Vth1, in the case of a voltage rise, and outputs the modulation signal Ms, which is at a level L when the signal As falls short of a voltage threshold Vth2, in the case of a voltage drop. As will be described later, a voltage threshold is set so as to satisfy a relationship of Vth1>Vth2.

The modulation signal Ms from the comparator 514 is supplied to the second gate driver 522 through logic inversion by the inverter 515. The modulation signal Ms is supplied to the first gate driver 521 without going through logic inversion. For this reason, logic levels supplied to the first gate driver 521 and the second gate driver 522 are in a relationship exclusive to each other.

The logic levels supplied to the first gate driver 521 and the second gate driver 522 may be controlled in terms of timing such that, in reality, the logic levels do not come at a level H simultaneously (such that the first transistor M1 and the second transistor M2 are not turned on simultaneously). For this reason, in the strict sense, the term "exclusive" means that the logic levels do not simultaneously come at a level H (the first transistor M1 and the second transistor M2 are not turned on simultaneously).

Although the term "modulation signal" means the modulation signal Ms in the narrow sense, the negative signal of the modulation signal Ms is also included in the modulation signal, considering that pulse-modulation is performed according to the underlying drive signal Aa. That is, a modulation signal obtained by pulse-modulation according to the underlying drive signal Aa includes not only the modulation signal Ms but also a signal obtained by inverting the logic level of the modulation signal Ms and a signal controlled in terms of timing.

Since the comparator 514 outputs the modulation signal Ms, a circuit ranging over to the comparator 514 or the inverter 515, that is, including the adder 512, the adder 513, the comparator 514, the inverter 515, the integral attenuator 516, and the attenuator 517, corresponds to the modulating unit 510 that generates a modulation signal.

The first gate driver 521 level-shifts a low logic amplitude, which is an output signal of the comparator 514, so as to be a high logic amplitude to output from a terminal Hdr. Out of power supply voltages of the first gate driver 521, a higher voltage is a voltage applied via a terminal Bst, and a lower voltage is a voltage applied via a terminal Sw. The terminal Bst is connected to one end of a capacitor C5 and a cathode electrode of a diode D10 for backflow prevention. The terminal Sw is connected to a source electrode of the first transistor M1, a drain electrode of the second transistor M2, the other end of the capacitor C5, and one end of an inductor L1. An anode electrode of the diode D10 is connected to a terminal Gvd, and a voltage Vm (for example, 7.5 V) output by the step-up circuit 540 is applied thereto. Therefore, a potential difference between the terminal Bst and the terminal Sw is substantially equal to a potential difference between both ends of the capacitor C5, that is, the voltage Vm (for example, 7.5 V).

The second gate driver 522 operates on a low electric potential side of the first gate driver 521. The second gate driver 522 level-shifts a low logic amplitude (level L: 0 V and level H: 3.3 V), which is an output signal of the inverter 515, to a high logic amplitude (for example, level L: 0 V and level H: 7.5 V) to output from a terminal Ldr. Out of power supply voltages of the second gate driver 522, the voltage Vm (for example, 7.5 V) is applied as a higher voltage, and a zero voltage is applied via a ground terminal Gnd as a lower voltage. That is, the ground terminal Gnd is earthed to the ground. In addition, the terminal Gvd is connected to the anode electrode of the diode D10.

The first transistor M1 and the second transistor M2 are, for example, N-channel field effect transistors (FET). In the first transistor M1 on a high side, out of the two transistors, a voltage Vh (for example, 42 V) is applied to a drain electrode and a gate electrode is connected to the terminal Hdr via a resistance R1. In the second transistor M2 on a low side, a gate electrode is connected to the terminal Ldr via a resistance R2 and a source electrode is earthed to the ground.

Therefore, when the first transistor M1 is turned off and the second transistor M2 is turned on, the voltage of the terminal Sw is 0 V and the voltage Vm (for example, 7.5 V) is applied to the terminal Bst. On the other hand, when the first transistor M1 is turned on and the second transistor M2 is turned off, Vh (for example, 42 V) is applied to the terminal Sw and Vh+Vm (for example, 49.5 V) is applied to the terminal Bst.

That is, with the capacitor C5 being as a floating power supply, the first gate driver 521 outputs an amplified control signal, of which level L is 0 V and level H is Vm (for example, 7.5 V), or of which level L is approximately Vh (for example, 42 V) and level H is approximately Vh+Vm (for example, 49.5 V), since a reference electric potential (the electric potential of the terminal Sw) changes to 0 V or Vh (for example, 42 V) according to operation of the first transistor M1 and the second transistor M2. The second gate driver 522 outputs an amplified control signal, of which level L is 0 V and level H is Vm (for example, 7.5 V), since a reference electric potential (the electric potential of the terminal Gnd) is fixed at 0 V regardless of operation of the first transistor M1 and the second transistor M2.

The other end of the inductor L1 is the terminal Out, which is an output of the drive circuit 50, and the drive signal COM-A from the terminal Out is supplied to the head substrate 36 via the cable 19 (refer to FIG. 2).

The terminal Out is connected to each of one end of a capacitor C1, one end of a capacitor C2, and one end of a resistance R3. Out of the above elements, the other end of the capacitor C1 is earthed to the ground. For this reason, the inductor L1 and the capacitor C1 function as a low pass filter 560 that smoothes out an amplified modulation signal, which appears at a connection point between the first transistor M1 and the second transistor M2.

The other end of the resistance R3 is connected to the terminal Vfb and one end of a resistance R4, and the voltage Vh is applied to the other end of the resistance R4. Accordingly, the drive signal COM-A, which has passed through the first feedback circuit 570 (circuit configured of the resistance R3 and the resistance R4) from the terminal Out, is pulled up to be fed back to the terminal Vfb.

The other end of the capacitor C2 is connected to one end of a resistance R5 and one end of a resistance R6. Out of the above elements, the other end of the resistance R5 is earthed to the ground. For this reason, the capacitor C2 and the resistance R5 function as a high pass filter that allows a high-frequency component of the drive signal COM-A from the terminal Out having a frequency that is equal to or higher than a cut-off frequency to pass therethrough. The cut-off frequency of the high pass filter is set to, for example, approximately 9 MHz.

The other end of the resistance R6 is connected to one end of a capacitor C4 and one end of a capacitor C3. Out of the above elements, the other end of the capacitor C3 is earthed to the ground. For this reason, the resistance R6 and the capacitor C3 function as a low pass filter that allows a low-frequency component having a frequency that is equal to or lower than a cut-off frequency to pass therethrough, out of signal components which have passed through the high pass filter. The cut-off frequency of the low pass filter is set to, for example, approximately 160 MHz.

Since the cut-off frequency of the high pass filter is set so as to be lower than the cut-off frequency of the low pass filter, the high pass filter and the low pass filter function as a band pass filter that allows a high-frequency component of the drive signal COM-A in a predetermined frequency range to pass therethrough.

The other end of the capacitor C4 is connected to the terminal Ifb of the integrated circuit device 500. Accordingly, out of high-frequency components of the drive signal COM-A, which has passed through the second feedback circuit 572 (circuit configured of the capacitor C2, the resistance R5, the resistance R6, the capacitor C3, and the capacitor C4) functioning as the band pass filter, a direct current component is cut and fed back to the terminal Ifb.

The drive signal COM-A output from the terminal Out is a signal obtained by smoothing out an amplified modulation signal at the connection point (terminal Sw) between the first transistor M1 and the second transistor M2 with a low pass filter configured of the inductor L1 and the capacitor C1. Since the drive signal COM-A is fed back to the adder 512 via the terminal Vfb after being integrated and subtracted, self-oscillation occurs at a frequency determined by a delay of feedback (a sum of a delay caused by smoothing-out of the inductor L1 and the capacitor C1 and a delay caused by the integral attenuator 516) and a transfer function of the feedback.

However, since the amount of a delay through a feedback path via the terminal Vfb is large, there is a case where the feedback via the terminal Vfb only is not enough to make the frequency of self-oscillation higher to an extent that the accuracy of the drive signal COM-A can be sufficiently ensured.

Thus, by providing a path through which a high-frequency component of the drive signal COM-A is fed back via the terminal Ifb in addition to the path via the terminal Vfb, a delay can be made shorter from a perspective of the entire circuit in the embodiment. For this reason, the frequency of the signal As, which is obtained by adding a high-frequency component of the drive signal COM-A to the signal Ab, becomes higher to an extent that the accuracy of the drive signal COM-A can be sufficiently ensured, compared to a case where there is no path via the terminal Ifb.

Figure 9:
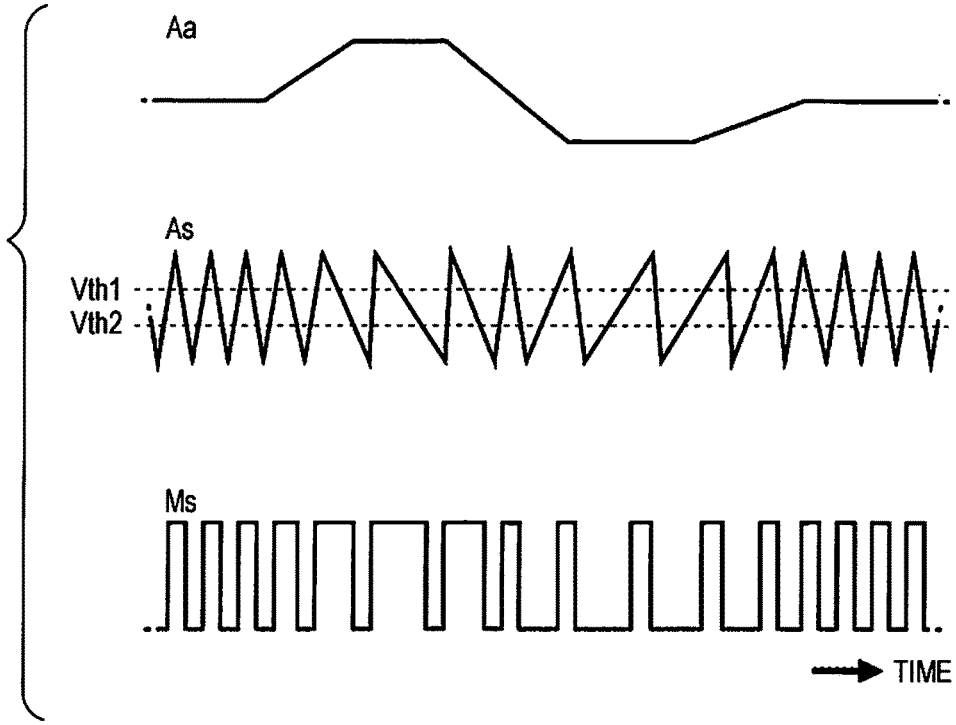
FIG. 9 is a diagram for illustrating operation of the drive circuit.

FIG. 9 is a diagram showing the waveform of the underlying drive signal Aa in association with the waveforms of the signal As and the modulation signal Ms.

As shown in FIG. 9, the signal As has a triangular wave, and the oscillation frequency thereof fluctuates according to the voltage (input voltage) of the underlying drive signal Aa. Specifically, the oscillation frequency becomes the highest in a case where an input voltage is an intermediate value. The oscillation frequency becomes lower as an input voltage becomes higher than the intermediate value or as an input voltage becomes lower than the intermediate value.

In addition, the upward inclination (rise of the voltage) and the downward inclination (drop of the voltage) of the triangular wave of the signal As are almost the same when an input voltage is close to an intermediate value. For this reason, the duty ratio of the modulation signal Ms, which is a result obtained by the comparator 514 comparing the signal As to the voltage thresholds Vth1 and Vth2, is almost 50%. When an input voltage becomes higher than the intermediate value, the downward inclination of the signal As becomes moderate. For this reason, a period for which the modulation signal Ms is at a level H becomes relatively longer and a duty ratio becomes higher. As an input voltage becomes lower than the intermediate value, the upward inclination of the signal As becomes moderate. For this reason, a period for which the modulation signal Ms is at a level H becomes relatively shorter and a duty ratio becomes lower.

For this reason, the modulation signal Ms becomes a pulse density modulation signal as follows. That is, the duty ratio of the modulation signal Ms is almost 50% when the input voltage has the intermediate value. As the input voltage becomes higher than the intermediate value, the duty ratio becomes higher. As the input voltage becomes lower than the intermediate value, the duty ratio becomes lower.

The first gate driver 521 turns the first transistor M1 on/off based on the modulation signal Ms. That is, the first gate driver 521 turns the first transistor M1 on when the modulation signal Ms is at a level H, and turns the first transistor off when the modulation signal Ms is at a level L. The second gate driver 522 turns the second transistor M2 on/off based on a logic inversion signal of the modulation signal Ms. That is, the second gate driver 522 turns the second transistor M2 off when the modulation signal Ms is at a level H, and turns the second transistor on when the modulation signal Ms is at a level L.

Therefore, the voltage of the drive signal COM-A, which is obtained by smoothing out the amplified modulation signal at the connection point between the first transistor M1 and the second transistor M2 with the inductor L1 and the capacitor C1, becomes higher as the duty ratio of the modulation signal Ms becomes higher, and becomes lower as the duty ratio becomes lower. Consequently, the drive signal COM-A is controlled so as to be a signal obtained by increasing and power-amplifying the voltage of the underlying drive signal Aa and is output.

Since pulse density modulation is used, the drive circuit 50 is advantageous in that the width of change in the duty ratio can be made larger compared to pulse width modulation in which a modulation frequency is fixed.

That is, since a minimum positive pulse width and a minimum negative pulse width, which can be dealt by the entire circuit, are restricted by properties of the circuit, only a predetermined range (for example, a range of 10% to 90%) can be ensured as the width of change in the duty ratio in pulse width modulation when a frequency is fixed. On the other hand, since the oscillation frequency becomes lower as an input voltage moves away from the intermediate value in pulse density modulation, the duty ratio can be made higher in a region with a high input voltage and the duty ratio can be made lower in a region with a low input voltage. For this reason, in self-oscillation pulse density modulation, a wider range (for example, a range of 5% to 95%) can be ensured as the width of change in the duty ratio.

The drive circuit 50 self-oscillates and a circuit that generates carrier waves having a high frequency, such as forced-oscillation, is not necessary. For this reason, the drive circuit is advantageous in that it is easy to integrate circuits other than a circuit dealing with a high voltage, that is, a portion of the integrated circuit device 500.

Since there is not only the path via the terminal Vfb but also the path through which a high-frequency component is fed back via the terminal Ifb as a feedback path of the drive signal COM-A in the drive circuit 50, a delay from a perspective of the entire circuit becomes shorter. For this reason, since the frequency of self-oscillation becomes higher, the drive circuit 50 can accurately generate the drive signal COM-A.

Referring back to FIG. 8, in an example shown in FIG. 8, the resistance R1, the resistance R2, the first transistor M1, the second transistor M2, the capacitor C5, the diode D10, and the low pass filter 560 configure the output circuit 550 that generates an amplified control signal based on a modulation signal and generates a drive signal based on the amplified control signal to output to a capacitive load (piezoelectric element 60).

The first power supply unit 530 applies a signal to a terminal that is different from a terminal to which a drive signal for the piezoelectric element 60 is applied. The first power supply unit 530 is configured of, for example, a constant voltage circuit such as a bandgap reference circuit. The first power supply unit 530 outputs the voltage VBS from a terminal Vbs. In the example shown in FIG. 8, the first power supply unit 530 generates the voltage VBS with a ground electric potential of the ground terminal Gnd being as reference.

The step-up circuit 540 supplies power to the gate driver 520. In the example shown in FIG. 8, the step-up circuit 540 steps up the voltage VDD supplied from the power supply terminal Vdd with the ground electric potential of the ground terminal Gnd being as reference and generates the voltage Vm, which is a power supply voltage on a high electric potential side of the second gate driver 522. Although the step-up circuit 540 can be configured of a charge pump circuit and a switching regulator, a case where the step-up circuit is configured of a charge pump circuit can better suppress the generation of a noise compared to a case where the step-up circuit is configured of a switching regulator. For this reason, since the drive circuit 50 can more accurately generate the drive signal COM-A and can control a voltage applied to the piezoelectric element 60 with high accuracy, the accuracy of discharging a liquid can be improved. Since a power generating unit of the gate driver 520 is miniaturized by configuring the step-up circuit of the charge pump circuit, it is possible to mount the gate driver on the integrated circuit device 500, and the entire area of the drive circuit 50 can be significantly reduced compared to a case where the power generating unit of the gate driver 520 is configured outside the integrated circuit device 500.

3.5 Configuration of Selection Control Unit and Selecting Unit

Figure 10:
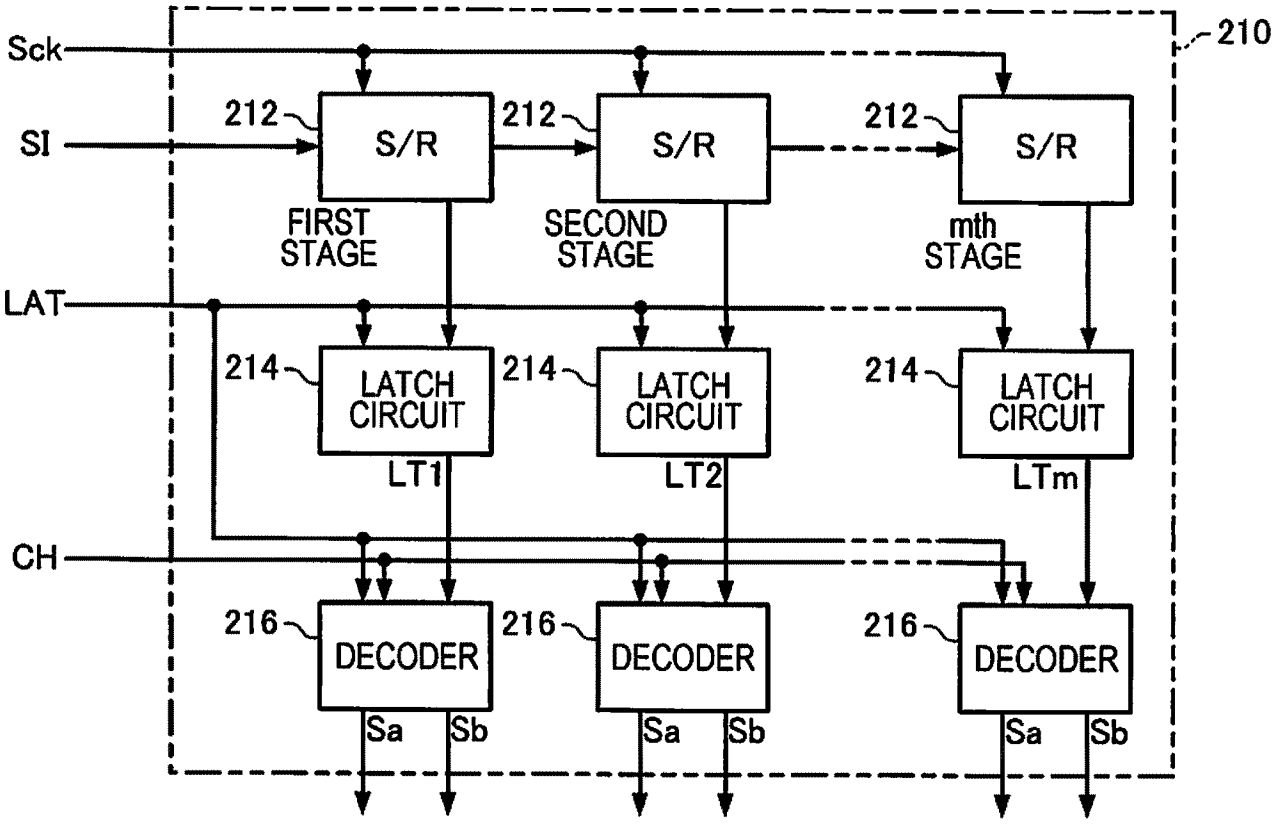
FIG. 10 is a diagram showing a configuration of a selection control unit.

FIG. 10 is a diagram showing a configuration of the selection control unit 210. As shown in FIG. 10, the clock signal Sck, the print data signal SI, the latch signal LAT, and the change signal CH are supplied to the selection control unit 210. A set of a shift register (S/R) 212, a latch circuit 214, and a decoder 216 is provided in the selection control unit 210 so as to correspond to the each of the piezoelectric elements 60 (nozzles 651).

The print data signal SI is in total 3m bit signals including 3-bit print data (SIH, SIM, SIL) for selecting any one of the "large dot", the "medium dot", the "small dot", the "non-recording", and the "inspection" with respect to each of the m discharging units 600.

The print data signal SI is serially supplied from the control signal restoring unit 320 in synchronization with the clock signal Sck. The shift register 212 has a configuration of temporarily holding the serially supplied print data signal SI for each of three bits of print data (SIH, SIM, SIL) corresponding to each of the nozzles 651.

Specifically, a configuration, in which the same number of the'shift registers 212 as the number of stages that correspond to the piezoelectric elements 60 (nozzles) are cascade-connected to each other and the serially supplied print data signal SI is subsequently transmitted to the next stage in accordance with the clock signal Sck, is adopted.

When the number of the piezoelectric elements 60 is m (m is a plural number), stages are expressed as a first stage, a second stage, . . . , and a mth stage in order of being on an upstream side where the print data signal SI is supplied in order to differentiate between the shift registers 212.

Each of the m latch circuits 214 latches 3-bit print data (SIH, SIM, SIL) held by each of the m shift registers 212 upon the rise of the latch signal LAT.

Each of the m decoders 216 decodes the 3-bit print data (SIH, SIM, SIL) latched by each of the m latch circuits 214, outputs selection signals Sa and Sb for each of the periods T1 and T2 defined by the latch signal LAT and the change signal CH, and defines the selection by the selecting unit 230.

Figures 11, 12:
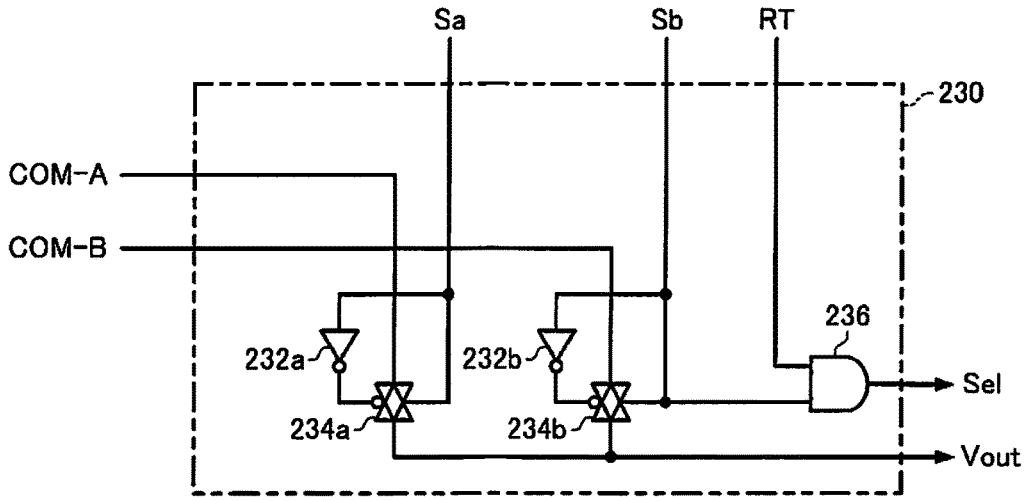
FIG. 11 is a diagram showing contents of decoding by a decoder.
FIG. 12 is a diagram showing a configuration of a selecting unit corresponding to one piezoelectric element (nozzle).

FIG. 11 is a diagram showing the contents of decoding by the decoder 216. For example, when the latched 3-bit print data (SIH, SIM, SIL) is (1, 0, 0), the decoder 216 sets the logic levels of the selection signals Sa and Sb to levels H and L respectively in the period T1, and to levels L and L respectively in the period T2 and outputs the signals.

The logic levels of the selection signals Sa and Sb are shifted by a level shifter (not illustrated) to higher amplitude logic than the logic levels of the clock signal Sck, the print data signal SI, the latch signal LAT, and the change signal CH.

FIG. 12 is a diagram showing a configuration of the selecting unit 230 corresponding to one piezoelectric element 60 (nozzle 651).

As shown in FIG. 12, the selecting unit 230 has inverters (NOT gate) 232*a* and 232*b*, the transfer gates 234*a* and 234*b*, and an AND gate 236.

The selection signal Sa from the decoder 216 is supplied to a positive control end of the transfer gate 234*a*, to which a circle is not attached, while being logically inverted by the inverter 232*a* and being supplied to a negative control end of the transfer gate 234*a*, to which a circle is attached. Similarly, the selection signal Sb is supplied to a positive control end of the transfer gate 234*b* while being logically inverted by the inverter 232*b* and being supplied to a negative control end of the transfer gate 234*b*.

The drive signal COM-A is supplied to an input end of the transfer gate 234*a* and the drive signal COM-B is supplied to an input end of the transfer gate 234*b*. Output ends of the transfer gates 234*a* and 234*b* are commonly connected to each other, and the drive signal Vout is output to the switching unit 340 via a common connection terminal.

When the selection signal Sa is at a level H, the transfer gate 234*a* electrically connects between the input end and the output end (switching on). When the selection signal Sa is at a level L, the transfer gate electrically disconnects between the input end and the output end (switching off). Similarly, the transfer gate 234*b* also switches on/off between the input end and the output end according to the selection signal Sb.

The AND gate 236 outputs a signal indicating a logical AND between the selection signal Sb and the switching period designation signal RT as the selection signal Sel to the switching unit 340.

Figure 13:
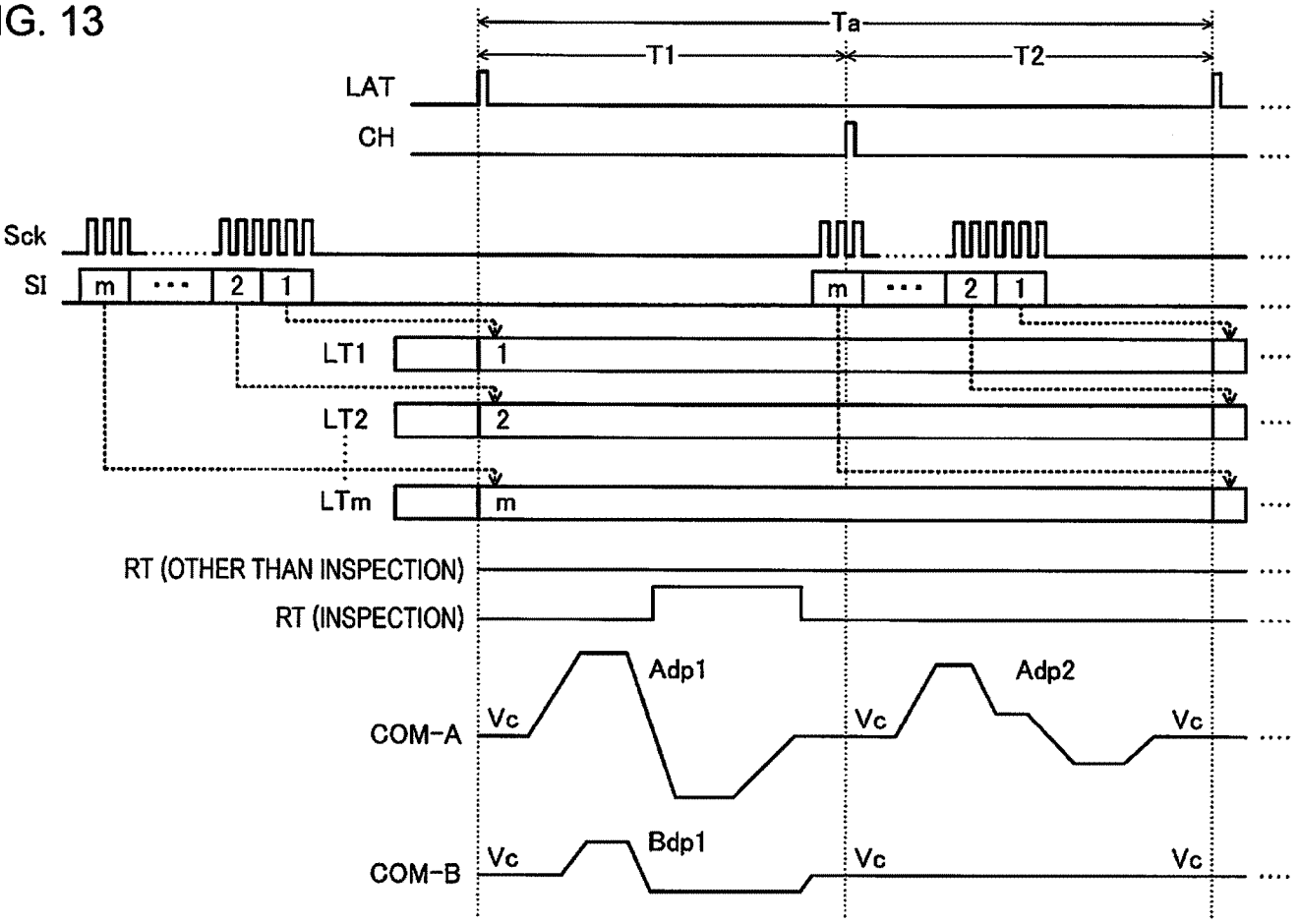
FIG. 13 is a diagram for illustrating operation of the selection control unit and operation of the selecting unit.

Next, operation of the selection control unit 210 and operation of the selecting unit 230 will be described with reference to FIG. 13.

The print data signal SI is serially supplied in synchronization with the clock signal Sck from the control signal restoring unit 320 and is subsequently transmitted to the shift register 212 corresponding to each nozzle. When the control signal restoring unit 320 stops supplying the clock signal Sck, the 3-bit print data (SIH, SIM, SIL) corresponding to each of the nozzles comes to a state of being held in each of the shift registers 212. The print data signal SI is supplied to the shift registers 212 corresponding to the nozzles at the last mth stage, . . . , the second stage, and the first stage in this order.

When the latch signal LAT rises, each of the latch circuits 214 simultaneously latches the 3-bit print data (SIH, SIM, SIL) held by each of the shift registers 212. In FIG. 13, LT1, LT2, . . . , and LTm indicate 3-bit print data (SIH, SIM, SIL) latched by the latch circuits 214 corresponding to the shift registers 212 at the first stage, the second stage, . . . , and the mth stage.

The decoder 216 outputs contents as shown in FIG. 11 such as the logic levels of the selection signals Sa and Sb in each of the periods T1 and T2 according to the size of a dot defined by the latched 3-bit print data (SIH, SIM, SIL).

That is, the decoder 216 sets the selection signals Sa and Sb to levels H and L in the period T1 and also to levels H and L in the period T2 in a case where the print data (SIH, SIM, SIL) is (1, 1, 0) and the size of a dot is defined as a large dot. The decoder 216 sets the selection signals Sa and Sb to levels H and L in the period T1 and to levels L and L in the period T2 in a case where the print data (SIH, SIM, SIL) is (1, 0, 0) and the size of a dot is defined as a medium dot. The decoder 216 sets the selection signals Sa and Sb to levels L and L in the period T1 and to levels H and L in the period T2 in a case where the print data (SIH, SIM, SIL) is (0, 1, 0) and the size of a dot is defined as a small dot. The decoder 216 sets the selection signals Sa and Sb to levels L and L in the period Ti and to levels L and L in the period T2 in a case where the print data (SIH, SIM, SIL) is (0, 0, 0) and non-recording is defined. In addition, the decoder 216 sets the selection signals Sa and Sb to levels L and H in the period Ti and also to levels L and H in the period T2 in a case where the print data (SIH, SIM, SIL) is (0, 0, 1) and inspection is defined.

When the print data (SIH, SIM, SIL) is (1, 1, 0), the selecting unit 230 selects the drive signal COM-A (trapezoidal waveform Adp1) since the selection signals Sa and Sb are at levels H and L in the period T1 and selects the drive signal COM-A (trapezoidal waveform Adp2) since the selection signals Sa and Sb are at levels H and L also in the period T2. As a result, the drive signal Vout corresponding to the "large dot" shown in FIG. 7 is generated.

When the print data (SIH, SIM, SIL) is (1, 0, 0), the selecting unit 230 selects the drive signal COM-A (trapezoidal waveform Adp1) since the selection signals Sa and Sb are at levels H and L in the period T1 and does not select either of the drive signals COM-A and COM-B since the selection signals Sa and Sb are at levels L and L in the period T2. As a result, the drive signal Vout corresponding to the "medium dot" shown in FIG. 7 is generated.

When the print data (SIH, SIM, SIL) is (0, 1, 0), the selecting unit 230 does not select either of the drive signals COM-A and COM-B since the selection signals Sa and Sb are at levels L and L in the period T1 and selects the drive signal COM-A (trapezoidal waveform Adp2) since the selection signals Sa and Sb are at levels H and L in the period T2. As a result, the drive signal Vout corresponding to the "small dot" shown in FIG. 7 is generated.

When the print data (SIH, SIM, SIL) is (0, 0, 0), the selecting unit 230 does not select either of the drive signals COM-A and COM-B since the selection signals Sa and Sb are at levels L and L in the period T1 and does not select either of the drive signals COM-A and COM-B since the selection signals Sa and Sb are also at levels L and L in the period T2. As a result, the drive signal Vout corresponding to the "non-recording" shown in FIG. 7 is generated.

When the print data (SIH, SIM, SIL) is (0, 0, 1), the selecting unit 230 selects the drive signal COM-B (trapezoidal waveform Bdp1) since the selection signals Sa and Sb are at levels L and H in the period T1 and selects the drive signal COM-B (constant voltage Vc) since the selection signals Sa and Sb are also at levels L and H in the period T2. As a result, the drive signal Vout corresponding to the "inspection" shown in FIG. 7 is generated.

Since either of the drive signals COM-A and COM-B are not selected in a period when the selection signals Sa and Sb are at levels L and L, one end of the piezoelectric element 60 is opened. However, the drive signal Vout is held at the immediately before voltage Vc due to a capacitive property of the piezoelectric element 60.

The drive signals COM-A and COM-B in the embodiment are merely examples. In fact, various combinations of waveforms prepared in advance according to a speed at which the head unit 20 moves and the characteristics of a printing medium are used.

Although an example in which the piezoelectric elements 60 bend upwards with a rise in the voltage has been described herein, the piezoelectric elements 60 bend downwards with a rise in the voltage when a voltage supplied to the electrodes 611 and 612 is reversed. For this reason, in a configuration where the piezoelectric elements 60 bend downwards with a rise in the voltage, the drive signals COM-A and COM-B given as examples in the embodiment have waveforms which are inverted with the voltage Vc being as reference.

3.6 Configuration of Switching Unit

Figure 14:
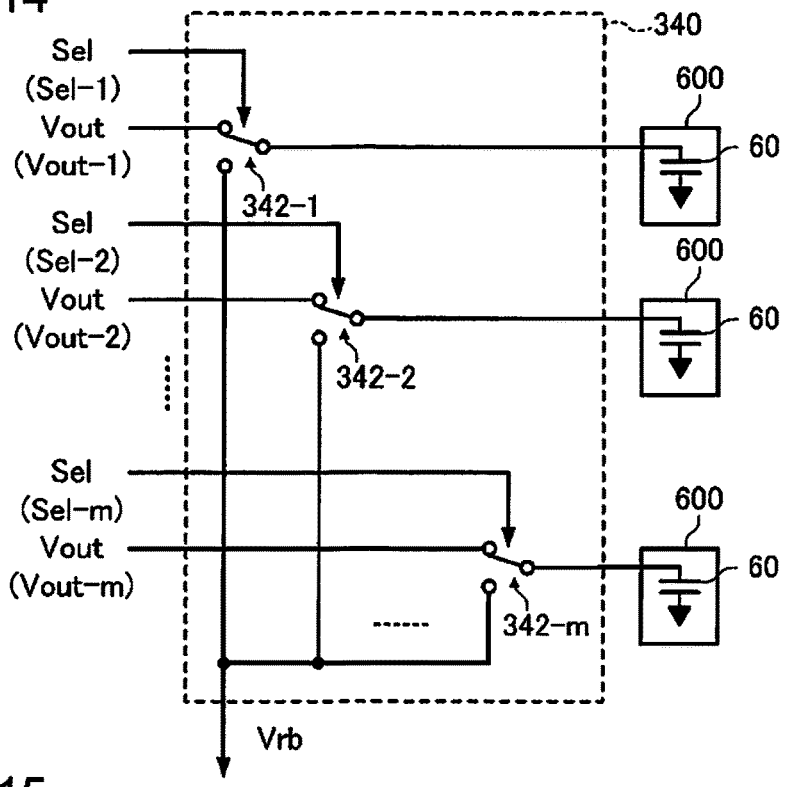
FIG. 14 is a diagram showing a configuration of a switching unit.

FIG. 14 is a diagram showing a configuration of the switching unit 340. As shown in FIG. 14, the switching unit 340 includes m switches 342-1 to **342-*m* connected to one end of each of the piezoelectric elements 60 of the m discharging units 600, and each of the m switches 342-1 to 342-*m* is controlled by each of the m selection signals Sel (Sel-1 to Sel-m) output from the m selecting units 230**.

Specifically, when the selection signal Sel-i is at a low level, the switch **342-*i* (i is any number of 1 to m) applies the drive signal Vout-i to one end of the piezoelectric element 60 of the ith discharging unit 600. In addition, when the selection signal Sel-i is at a high level, the switch 342-*i* does not apply the drive signal Vout-i to one end of the piezoelectric element 60 of the ith discharging unit 600 and selects a signal generated at one end of the piezoelectric element 60 as the residual vibration signal Vrb. Since the switching period designation signal RT is at a low level and all of the m selection signals Sel (Sel-1 to Sel-m) are at a low level during printing, the drive signals Vout (Vout-1 to Vout-m) corresponding to any one of the "large dot", the "medium dot", the "small dot", and the "non-recording" is supplied to the m discharging units 600. In addition, during inspection, the drive signal Vout-i corresponding to the "inspection" is supplied to the ith (i is any number of 1 to m) discharging unit 600, which is an inspection target, when the selection signal Sel-i is at a low level (switching period designation signal RT is at a low level) and a signal from the ith discharging unit 600 is output from the switching unit 340 as the residual vibration signal Vrb when the selection signal Sel-i is at a high level (switching period designation signal RT is at a high level). During inspection, another selection signal Sel-j (j is any number of 1 to m, excluding i) is at a low level and a drive signal corresponding to the "non-recording" is supplied to the discharging unit 600**, which is a non-inspection target.

Figure 15:
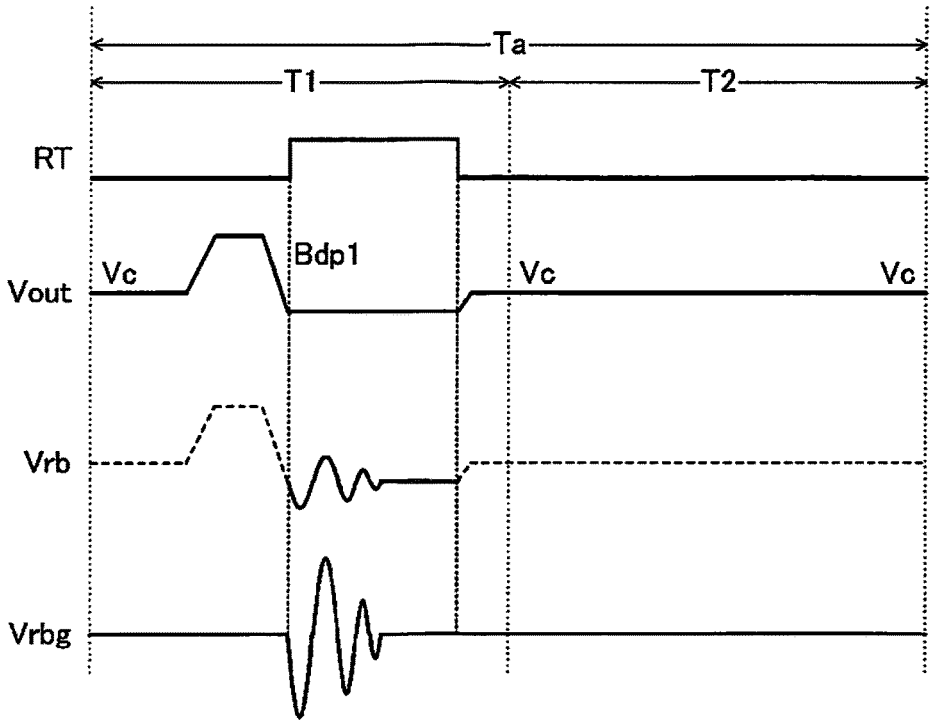
FIG. 15 is a diagram showing an example of waveforms of a switching period designation signal, a drive signal applied to the discharging unit, which is an inspection target, and a residual vibration signal, during inspection.

FIG. 15 shows an example of the waveforms of the switching period designation signal RT, the drive signal Vout applied to the discharging unit 600, which is an inspection target, and the residual vibration signal Vrb, during inspection. FIG. 15 also shows the waveform of the residual vibration signal Vrbg output from the amplification unit 350 (refer to FIG. 2). As shown in FIG. 15, when the switching period designation signal RT is at a low level, the drive signal Vout (drive signal COM-B for inspection) is applied to the discharging unit 600, which is an inspection target. In addition, when the switching period designation signal RT is at a high level, the drive signal Vout is not applied to the discharging unit 600, which is an inspection target, and a waveform generated by residual vibration after the drive signal Vout is applied to the discharging unit 600 appears in the residual vibration signal Vrb. Then, the residual vibration signal Vrb is amplified by the amplification unit 350 and becomes residual vibration signal Vrbg, and the residual vibration signal Vrbg is transmitted to the state signal converting unit 370 provided in the control substrate 10. That is, the residual vibration signal Vrbg in the embodiment is an analog signal of which waveform, which is generated by residual vibration after the drive signal Vout is applied to the discharging unit 600, is amplified.

Figure 16:
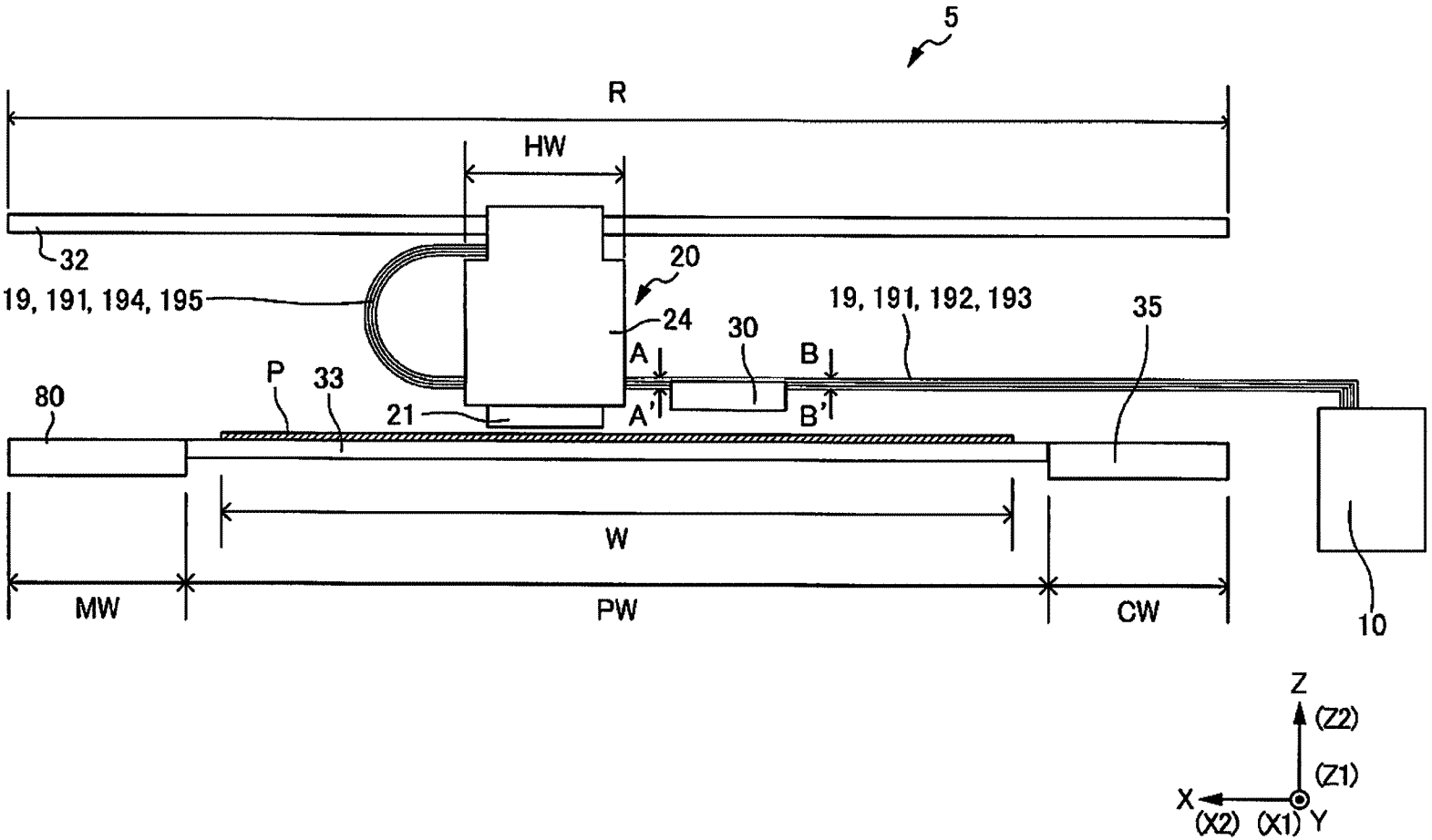
FIG. 16 is a diagram showing a configuration of a printing unit when seen in a sub-scanning direction in an embodiment.
Figure 17:
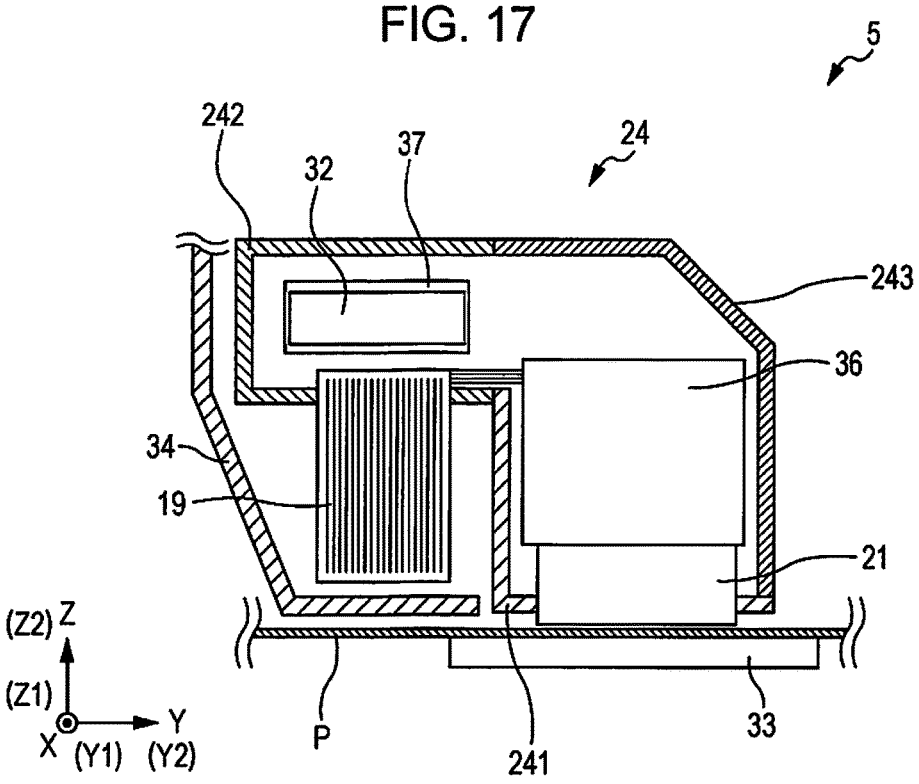
FIG. 17 is a diagram showing an internal configuration of a head unit when seen in a main scanning direction in the embodiment.

4. Configuration of Printing Unit 4.1 Configuration and Disposition of Printing Unit A configuration of the printing unit 5 in the embodiment will be described with reference to FIGS. 16 and 17. FIG. 16 is a view illustrating the configuration of the printing unit 5 when seen in the sub-scanning direction Y, and FIG. 17 is a view illustrating an internal configuration of the carriage 24 when seen in the main scanning direction X. Also in FIGS.

16 and 17, the moving direction of the carriage 24 will be referred to as the main scanning direction X, the transporting direction of the printing medium P will be referred to as the sub-scanning direction Y, and the vertical direction of the liquid discharging apparatus 1 will be referred to as the vertical direction Z, as in FIG. 1. In FIGS. 16 and 17, a side of the main scanning direction X where the control substrate 10 is provided will be referred to as X1, and a side opposite thereto will be referred to as X2. An upstream side of the transporting direction of the printing medium P, which is the sub-scanning direction Y, will be referred to as Y1, and a downstream side will be referred to as Y2. A vertically lower side of the vertical direction Z will be referred to as Z1, and a vertically upper side will be referred to as Z2.

The printing unit 5 is configured so as to include the control substrate 10, the head unit 20, the drive substrate 30, the cables 19, the carriage guide shaft 32, a platen 33, a capping mechanism 35, and the maintenance mechanism 80. That is, in the embodiment, the control substrate 10, the head unit 20, and the drive substrate 30 are configured independently of each other.

The carriage guide shaft 32 is provided in the main scanning direction X and supports the head unit 20. That is, the head unit 20 moves (reciprocates) within an area of a movable region R along the carriage guide shaft 32 based on control by the carriage moving mechanism 41 (refer to FIG. 2).

The head unit 20 includes the carriage 24 and the head 21 mounted on the carriage 24.

The carriage 24 includes a carriage main body 241 which has an L-shape when seen in the main scanning direction X, a carriage supporting unit 242 which is connected to the carriage guide shaft 32, and a carriage cover 243 which is included so as to make a closed space between the carriage main body 241 and the carriage supporting unit 242.

The head 21 and the head substrate 36 are mounted on the carriage main body 241.

The head 21 is mounted on the Z1 side of the carriage 24, and the nozzles 651 and the printing medium P are provided so as to oppose each other through an opening portion (not illustrated) of the carriage 24.

The head substrate 36 is provided on the Z2 side of the head 21 and is connected to the cables 19. The head substrate 36 generates the drive signal Vout in accordance with a plurality of signal processing units (the control signal receiving unit 310, the control signal restoring unit 320, the selection control unit 210, the selecting units 230, and the state signal generating unit 380 (refer to FIG. 2)), and outputs the signal to the head 21. The head 21 discharges an ink supplied from the ink storing unit 8 as ink droplets onto the printing medium P based on the input drive signal Vout.

The carriage supporting unit 242 is included on an upper (Z2 side) rear (Y1 side) portion of the carriage main body 241, and a front end portion thereof is fixed to the carriage main body 241.

The carriage supporting unit 242 has an insertion-hole 37. By inserting the carriage guide shaft 32 into the insertion-hole 37, the carriage supporting unit 242 is supported by the carriage guide shaft 32 along with the carriage main body 241. In addition, the cables 19 are inserted in the carriage supporting unit 242. The cables 19 are connected to the head substrate 36 mounted on the carriage main body 241 by going through the inside of the carriage supporting unit 242. Accordingly, the drive signals COM-A and COM-B and the plurality of control signals (the clock signal Sck, the print data signal SI, the latch signal LAT, the change signal CH, and the switching period designation signal RT) are input into the head substrate 36.

That is, by the carriage guide shaft 32 supporting the carriage 24, the head unit 20 moves (reciprocates) within the area of the movable region R along the carriage guide shaft 32 based on control by the carriage moving mechanism 41 (refer to FIG. 2).

The platen 33 is provided on a surface that is different from a surface of the printing medium P that opposes the head 21. A roller (not illustrated) that transports the printing medium P is provided on the platen 33, transports the printing medium P in the sub-scanning direction Y, and holds the printing medium P on the Z1 side when ink droplets are discharged on the printing medium P. That is, a maximum width (hereinafter, referred to as a "maximum printing width") that allows the printing unit 5 of the liquid discharging apparatus 1 to perform serial printing is equal to a platen width PW, which is the width of the platen 33 in the main scanning direction X. The platen width PW is set so as to be wider than a standard dimension Ws of a medium width W, which is the width of the printing medium P in the main scanning direction X, in order to hold and transport the printing medium P in a stable manner. In the embodiment, the platen width PW (that is, the maximum printing width) satisfies $Ws<PW\leq Ws\times1.15$ with respect to the standard dimension Ws. In other words, the liquid discharging apparatus 1 corresponding to the standard dimension Ws is a printer of which maximum printing width is larger than the standard dimension Ws and is equal to or smaller than 115% of the standard dimension Ws.

For example, the liquid discharging apparatus 1, of which standard dimension Ws of the medium width W is 24 inches, is a printer (called as a "24-inch corresponding printer") of which maximum printing width corresponds to 24 inches, specifically, is a printer of which maximum printing width is larger than 24 inches and is equal to or smaller than 27.6 inches. The liquid discharging apparatus 1, of which standard dimension Ws of the medium width W is 36 inches, is a printer (called as a "36-inch corresponding printer") of which maximum printing width corresponds to 36 inches, specifically, is a printer of which maximum printing width is larger than 36 inches and is equal to or smaller than 41.4 inches. The liquid discharging apparatus 1, of which standard dimension Ws of the medium width W is 44 inches, is a printer (called as a "44-inch corresponding printer") of which maximum printing width corresponds to 44 inches, specifically, is a printer of which maximum printing width is larger than 44 inches and is equal to or smaller than 50.6 inches. The liquid discharging apparatus 1, of which standard dimension Ws of the medium width W is 64 inches, is a printer (called as a "64-inch corresponding printer") of which maximum printing width corresponds to 64 inches, specifically, is a printer of which maximum printing width is larger than 64 inches and is equal to or smaller than 73.6 inches.

In addition, a home position is set on the X1 side of the platen 33. The home position is a starting point of movement (reciprocation) of the head unit 20, and the capping mechanism 35, which seals a nozzle formed surface of the head 21, is provided at the home position. The home position is also a position where the head unit 20 stands by when the liquid discharging apparatus 1 does not execute printing. That is, it is preferable that a capping mechanism width CW, which is the width of the home position (capping mechanism 35) in the main scanning direction X, be equal to or larger than a head unit width HW, which is the width of the head unit 20 in the main scanning direction X.

The maintenance mechanism 80 is provided on the X2 side of the platen 33. The maintenance mechanism 80 performs cleaning processing (pumping processing), in which thickened inks and bubbles in the discharging units 600 are suctioned by a tube pump (not illustrated), and wiping processing, in which foreign substances, such as paper dust stuck around the nozzles of the discharging units 600, are wiped off by a wiper, as maintenance processing. It is preferable that the head unit 20 and the platen 33, which is a printing region, do not overlap each other when seen in the vertical direction Z during the execution of the maintenance processing. That is, it is preferable that a maintenance mechanism width MW, which is the width of the maintenance mechanism 80 in the main scanning direction X, be equal to or larger than the head unit width HW, which is the width of the head unit 20 in the main scanning direction X.

Therefore, the movable region R where the head unit 20 in the embodiment moves (reciprocates) in the main scanning direction X is configured so as to include at least the platen width PW, the capping mechanism width CW, and the maintenance mechanism width MW. The movable region R may include other configurations, and may have a gap between the configurations.

The drive substrate 30 (an example of a "drive circuit substrate") is connected to the head unit 20 by the cables 19 (the FFC 194 and the FFC 195 shown in FIG. 2). In the embodiment, the drive substrate 30 is fixed to a housing (not illustrated) of the main body 2. That is, by the cables 19 that connect the head unit 20 and the drive substrate 30 together being deformed in response to the movement (reciprocation) of the head unit 20 and following the movement of the head unit, the drive signals COM-A and COM-B are transmitted to the head unit 20 that moves (reciprocates) from the drive substrate 30. The drive substrate 30 may be accommodated in a case and be fixed to the housing (not illustrated) of the main body 2.

The control substrate 10 (an example of a "control circuit substrate") is connected to the drive substrate 30 by the cables 19 (the FFC 192 and the FFC 193 shown in FIG. 2). The control substrate 10 is fixed to the housing (not illustrated) of the main body 2. Therefore, the cables 19 (the FFC 192 and the FFC 193 shown in FIG. 2) that connect the control substrate 10 and the drive substrate 30 together are not deformed in response to the movement (reciprocation) of the head unit 20 and do not follow the movement of the head unit. The control substrate 10 may be accommodated in a case and be fixed to the housing (not illustrated) of the main body 2.

The shortest distance between the control substrate 10 and the moving carriage 24 is set so as to be longer than the shortest distance between the drive substrate 30 and the moving carriage 24. That is, the drive substrate 30 is provided so as to be closer to the head unit 20 than the control substrate 10. Accordingly, it is possible to make the wired lengths of the cables 19 that connect the drive substrate 30 and the head unit 20 together shorter.

By making the wired lengths of the cables 19 that connect the drive substrate 30 and the head unit 20 together shorter, the impedance of the cables 19 reduce. Accordingly, the occurrence of waveform distortion of the drive signals COM-A and COM-B, which is attributable to impedance components of the cables 19, is reduced. Therefore, the accuracy of the drive signals COM-A and COM-B transmitted to the head unit 20 improves and the accuracy of discharging of ink droplets improves.

By making the wired lengths of the cables 19 that connect the drive substrate 30 and the head unit 20 together shorter, the inductance of the cables 19 also reduce. Accordingly, the occurrence of overshoot of the drive signals COM-A and COM-B, which is attributable to stray inductance components of the cables 19, is reduced. Therefore, a possibility that the head unit 20 breaks down due to overvoltage caused by overshoot is reduced and the reliability of the liquid discharging apparatus 1 including the head unit 20 improves.

When seen horizontally with respect to a discharge surface in the sub-scanning direction Y, which is orthogonal to the main scanning direction X, the drive substrate 30 is provided at a position that overlaps at least a part of a region where the carriage 24 moves. It is preferable that the drive substrate 30 be disposed close to the carriage 24 when seen horizontally with respect to the discharge surface in the main scanning direction X. The drive substrate 30 may be provided on the Y1 side with respect to a moving region of the carriage 24, or may be provided on the Y2 side.

Accordingly, it is possible to make the wired lengths of the cables 19 that connect the head unit 20 and the drive substrate 30 together even shorter. The region where the carriage 24 moves is a region where the carriage 24 passes through when the carriage 24 moves from an X1 side end portion of the carriage guide shaft 32 to an X2 side end portion.

By making the wired lengths of the cables 19 that connect the head unit 20 and the drive substrate 30 together as short as possible, impedance components of the cables 19 reduce and the accuracy of the drive signals COM-A and COM-B transmitted to the head unit 20 improves. The head unit 20 moves (reciprocates) in the movable region R and discharges ink droplets onto the printing medium P to perform printing. For this reason, it is necessary for the cables 19 to have lengths that do not hinder the movement of the head unit 20.

For this reason, when the discharge surface is seen horizontally in the sub-scanning direction Y, which is orthogonal to the main scanning direction X, it is preferable that the drive substrate 30 be provided in the vicinity of a middle portion of the movable region R where the carriage 24 moves. The vicinity of the middle portion refers to a region which corresponds to ±10% of the middle portion of the movable region R of the carriage 24 (for example, 400 mm to 600 mm from one end of the movable region R when the movable region R is 1,000 mm).

By providing the drive substrate 30 in the vicinity of the middle portion of the movable region R of the carriage 24, it is possible to make the wired lengths of the cables 19 that connect the head unit 20 and the drive substrate 30 together as short as possible without hindering the movement of the carriage 24. Accordingly, the inductance and impedance of the cables 19 can be reduced. Therefore, it is possible to further improve the accuracy of the drive signals COM-A and COM-B transmitted to the head unit 20.

When the discharge surface is seen horizontally in the sub-scanning direction Y, which is orthogonal to the main scanning direction X, the control substrate 10 is provided at a position where the control substrate does not overlap the region in which the carriage 24 moves.

By the control substrate 10 being included outside the region where the carriage 24 moves, the sticking of ink droplets discharged from the head unit 20 to the control substrate 10 can be reduced. Accordingly, it is possible for the control substrate 10 to reduce the occurrence of a defect such as an insulation failure caused by sticking of ink droplets. Therefore, the reliability of the control substrate 10 can be further improved.

Although the control substrate 10 may be provided, for example, on any of the X1 side of the home position, the X2 side of the maintenance mechanism 80, the Z1 side of the platen 33, and the Z2 side of the movable region of the carriage 24, it is preferable for the control substrate to be provided on an upper side (Z2 side) of the vertical direction Z with respect to the discharge surface from which ink droplets are discharged from the head 21 onto the printing medium P. Accordingly, the sticking of ink droplets discharged from the head unit 20 to the control substrate 10 can be further reduced.

In the embodiment, when seen in the sub-scanning direction Y, the drive substrate 30 is disposed in the vicinity of the middle portion of the movable region R, when seen in the main scanning direction X, the drive substrate is disposed on the Y1 side of the carriage main body 241 of the carriage 24, and the drive substrate is disposed on the Z1 side of the carriage supporting unit 242. Accordingly, the drive substrate 30 is provided close to the moving region of the carriage 24 without hindering the movement of the carriage 24.

The control substrate 10 is provided on the X1 side of the home position of the carriage 24, and is provided, for example, between the operation unit 7 and the ink storing unit 8 illustrated in FIG. 1.

Accordingly, it is possible to make the wired lengths of the cables 19 that connect the drive substrate 30 and the head unit 20 together shorter without the drive substrate 30 in the embodiment hindering the movement of the head unit 20. Therefore, it is possible for the drive substrate 30 to accurately transmit the drive signals COM-A and COM-B to the head unit 20. The sticking of ink droplets to the control substrate 10 can be reduced, and the reliability of the control substrate 10 can be further improved.

The liquid discharging apparatus 1 in the embodiment may discharge ink droplets at a frequency of 30 kHz or higher to realize high-speed printing. There is concern over an increase in the amount of heat generated in the drive substrate 30 based on an overvoltage component when the discharge frequency of the ink droplets increases in a state where overvoltage caused by overshoot has occurred in the drive signals COM-A and COM-B to be input into the head unit 20. In the embodiment, it is possible to make the wired lengths of the cables 19 that connect the head unit 20 and the drive substrate 30 together shorter. Accordingly, it is possible to reduce the occurrence of overvoltage, which occurs in the drive signals COM-A and COM-B. Therefore, even when a frequency at which ink droplets are discharged is increased, the amount of heat generated in the drive substrate 30 due to an overvoltage component is reduced. Therefore, in the embodiment, the head unit 20 may discharge ink droplets at a frequency of 30 kHz or higher. Accordingly, it is possible for the liquid discharging apparatus 1 to perform high-speed printing.

The liquid discharging apparatus 1 in the embodiment is a large format printer that performs serial printing. The cables 19 that connect the drive substrate 30 and the head unit 20 together are deformed and are movable, and follow the moving the head unit 20.

When a medium to be printed is a medium having a size in a short side direction that is smaller than A3, inductance and impedance attributable to wiring through which a drive signal is transmitted do not have a large effect on the discharging of a liquid. In serial printing in which a carriage is moved to perform printing, a cable through which a drive signal is transmitted is deformed in response to the movement of the carriage and follows the movement of the carriage. For this reason, for example, when the size of the printing medium P in the short side direction is larger, a region where the carriage moves becomes larger. For this reason, it is necessary for the wired lengths of the cables 19 that connect the drive substrate 30 and the head unit 20 together to be long enough to follow the movement of the carriage, and thus the inductance and impedance of the cables 19 increase.

Therefore, the liquid discharging apparatus 1, in which the control substrate 10, the head unit 20, and the drive substrate 30 are separately provided as described in the embodiment, is particularly effective when the length of the cables 19 that connect the drive substrate 30 and the head unit 20 together are approximately 1 m to 2 m. Therefore, it is preferable that the width of the printing medium P in the short side direction be equal to or larger than 24 inches and is equal to or smaller than 70 inches, and it is preferable that the liquid discharging apparatus 1 according to the embodiment be, in particular, the liquid discharging apparatus 1 (large format printer) corresponding to a medium size such as 24 inches, 36 inches, 44 inches, and 64 inches.

4.2 Configuration of Cable and Signal Transmitted through Cable

Figure 18:
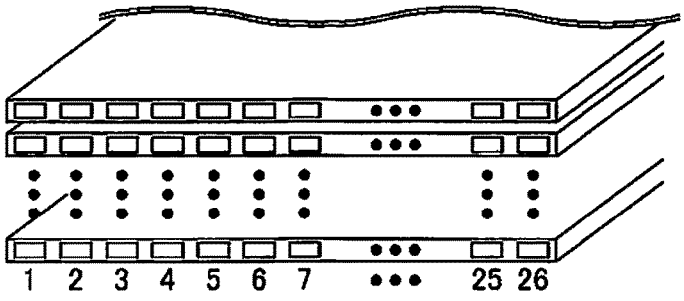
FIG. 18 is a view illustrating a configuration of a cable connecting the head unit, a drive substrate, and a control substrate together in the embodiment.

FIGS. 18, 19, and 20 are schematic diagrams showing configurations of the cables 19 in the embodiment. It is preferable that flexible flat cables (FFC), which are deformed in response to the movement of the carriage 24 and can follow the movement of the carriage, be used as the cables 19 in the embodiment.

The cables 19 are configured such that the plurality of (four in FIGS. 19 and 20) cables 19 overlap each other as illustrated in FIG. 18. Specifically, the cables 19 are provided such that the cables 19, each of which having the same number (26, in the embodiment) of core wires, overlap each other with the core wires having the same core numbers opposing each other.

FIG. 19 is a diagram showing configurations of the cables 19 that connect the head unit 20 and the drive substrate 30 together. In the embodiment, the four cables 19 are configured so as to overlap each other. In FIG. 19, the plurality of overlapping cables 19 will be described as, from a side closer to the printing medium P, a first FFC, a second FFC, a third FFC, and a fourth FFC in a portion (an A-A' portion in FIG. 16) immediately before being connected to the drive substrate 30.

As shown in FIG. 19, the FFC 194 (refer to FIG. 2) through which the drive signals COM-A and COM-B are transmitted is provided in each of the first FFC and the second FFC. Specifically, the drive signal COM-Ai (i=1 to m) and the voltage VBS are alternately provided in the first FFC. More specifically, core wires with odd numbers are provided with the voltage VBS, and core wires with even numbers are provided with the drive signal COM-Ai (i=1 to m). In addition, the drive signal COM-Bi (i=1 to m) and the voltage VBS are alternately provided in the second FFC. Specifically, core wires with odd numbers are provided with the drive signal COM-Bi (i=1 to m), and core wires with even numbers are provided with the voltage VBS.

That is, the voltage VBS is allotted to the core wires of the second FFC opposing the core wires of the first FFC, through which the drive signal COM-Ai (i=1 to m) is transmitted, and the voltage VBS is allotted to the core wires of the first FFC opposing the core wires of the second FFC through which the drive signal COM-Bi (i=1 to m) is transmitted. Currents in opposite directions flow in the drive signal COM-Ai (i=1 to m) or the drive signal COM-Bi (i=1 to m) and the voltage VBS. By disposing core wires through which the drive signal COM-A (or COM-B) is transmitted and core wires through which the voltage VBS is transmitted so as to oppose each other as shown in FIG. 19, electromagnetic fields generated by currents flowing in the core wires cancel each other out. Thus, it is possible to reduce the impedance of the core wires.

The core wires with even numbers in the first FFC may be provided with the voltage VBS and the core wires with odd numbers may be provided with the drive signal COM-Ai (i=1 to m). At this time, the core wires with even numbers in the second FFC are provided with the drive signal COM-Bi (i=1 to m), and the core wires with odd numbers are provided with the voltage VBS.

The FFC 195 through which a state signal, which is an analog signal, is transmitted from the state signal generating unit 380 to the state signal converting unit 370 is provided in the third FFC. The state signal indicates state information detected in the head unit 20, and is transmitted to the drive substrate 30 through the third FFC. For this reason, it is preferable that the signal transmitted through the third FFC be a signal having a constant electric potential, such as a ground electric potential (GND in FIG. 19) and a power supply electric potential (VDD FIG. 19), in addition to a state signal (the residual vibration signal Vrbg, the temperature signal Vtemp, and the abnormality signal XHOT in the embodiment). Accordingly, it is possible to reduce superimposition of a noise onto a state signal (the residual vibration signal Vrbg, the temperature signal Vtemp, and the abnormality signal XHOT in the embodiment) transmitted through the third FFC.

The differential signals of the plurality of types of original control signals (the original clock signal sSck, the original print data signal sSI, and the original latch signal sLAT) for controlling discharging are transmitted through the fourth FFC. Although other original control signals such as the original change signal sCH and the original switching period designation signal sRT are also transmitted through the fourth FFC, the signals are not shown in FIG. 19. By providing the third FFC with a high ground electric potential (or a power supply electric potential) between the second FFC and the fourth FFC, interference between the drive signals COM-A and COM-B with high voltage amplitudes and the plurality of types of weak original control signals for controlling discharging is reduced.

FIG. 20 is a diagram showing configurations of the cables 19 that connect the drive substrate 30 and the control substrate 10 together. In the embodiment, the four cables 19 are configured so as to overlap each other. Also in FIG. 20, the plurality of overlapping cables 19 will be described as, from the side closer to the printing medium P, a fifth FFC, a sixth FFC, a seventh FFC, and an eighth FFC in a portion (a B-B' portion in FIG. 16) immediately before being connected to the drive substrate 30, as in FIG. 19.

As shown in FIG. 20, the FFC 192 (refer to FIG. 2) through which original drive differential signals dDSA and dDSB, which are differential signals, are transmitted is provided in each of the fifth FFC and the sixth FFC. Specifically, a ground electric potential (GND in FIG. 20) is allotted to a first core wire, a fourth core wire, . . . , and a 3n+1th core wire (n=0 to m) of the fifth FFC, for example, original drive differential data pieces sdA1+ and sdA1−, which are a set of the original drive differential signal dDSA, are allotted to the second core wire and the third core wire, for example, original drive differential data pieces sdB1+ and sdB1−, which are a set of the original drive differential signal dDSB, are allotted to the fifth core wire and the sixth core wire, and original drive differential data pieces sdAi+ and sdAi− (or sdBi+ and sdBi−) (i=0 to j), which are a set of the original drive differential signal dDSA (or sDSB), are allotted to a 3n+2th core wire (n=0 to m) and a 3n+3th core wire (n=0 to m) core wire. In addition, a ground electric potential is allotted to the sixth FFC.

Specifically, the FFC 192 (an example of a "first cable") includes the fifth FFC and the sixth FFC, and is a cable that electrically connects the drive substrate 30 and the control substrate 10 together. The original drive differential data pieces sdA1+ and sdA1−, which are differential signals, are transmitted through a second core wire (an example of "second wiring") of the fifth FFC and the third core wire (an example of "third wiring") of the fifth FFC, and a ground electric potential (an example of a "constant voltage signal") is transmitted through a first core wire (an example of "first wiring") of the fifth FFC, a fourth core wire (an example of "fourth wiring") of the fifth FFC, a second core wire (an example of "fifth wiring") of the sixth FFC, and a third core wire (an example of "sixth wiring") of the sixth FFC. In addition, the second core wire of the fifth FFC and the second core wire of the sixth FFC are disposed so as to oppose each other, and the third core wire of the fifth FFC and the third core wire of the sixth FFC are disposed so as to oppose each other.

That is, the perimeter of a core wire through which the original drive differential signal sDSA (or sDSB) is transmitted is covered with a core wire through which a ground electric potential is transmitted. The original drive differential signal dDSA (or sDSB) is a weak differential signal. By disposing a core wire through which a ground electric potential is transmitted on the perimeter of the core wire through which the original drive differential signal is transmitted, it is possible to reduce an effect of external noises. Accordingly, the accuracy of the original drive data pieces sdA and sdB used in generating the drive signals COM-A and COM-B improves. By improving the accuracy of the original drive data pieces sdA and sdB, the accuracy of the drive signals COM-A and COM-B output from the drive substrate 30 also improves. Therefore, it is possible to stabilize discharging by the liquid discharging apparatus 1.

It is preferable that other cables be not interposed between the fifth FFC and the sixth FFC. In addition, the ground electric potential transmitted through the fifth FFC and the sixth FFC may be a stable electric potential, or may be, for example, a power supply electric potential. In addition, a signal different from a constant electric potential including a ground electric potential may be transmitted through core wires in the sixth FFC opposing core wires of the ground electric potential in the fifth FFC.

The FFC 193 through which a state signal converted to a digital signal by the state signal converting unit 370 of the drive substrate 30 is provided in the seventh FFC. The state signal transmitted through the seventh FFC is a signal obtained by the state signal converting unit 370 of the drive substrate 30 converting state information on the head substrate 36 and the head 21 to a digital signal. By the state signal converting unit 370 of the drive substrate 30 converting a state signal to a digital signal, it is possible to suppress superimposition of noises and transmit an accurate state of the head substrate 36 and an accurate state of the head 21 to the control substrate 10.

The differential signals of the plurality of types of original control signals (the original clock signal sSck, the original print data signal sSI, and the original latch signal SLAT) for controlling discharging are transmitted through the eighth FFC. Although other original control signals such as the original change signal sCH and the original switching period designation signal sRT are also transmitted through the eighth FFC, the signals are not shown in FIG. 20.

The FFC 191 is in the fourth FFC shown in FIG. 19 as well as in the eighth FFC shown in FIG. 20. As shown in FIG. 2, the FFC 191 connects the control substrate 10 and the head unit 20 together and allows the original control differential signals dCS to be transmitted therethrough without going through the drive substrate 30. At this time, it is preferable that the FFC 191 in the A-A' portion (or the B-B' portion) of FIG. 16 be disposed so as to be the closest to the Z2 side among the plurality of overlapping cables 19. By disposing in this manner, it is possible to connect the FFC without the FFC 191 of the cable 19 and other cables intersecting each other. Accordingly, it is possible for the plurality of overlapping cables 19 to reduce signal interference between cables, the accuracy of a signal to be transmitted can be improved, and it is possible to more accurately discharge ink droplets.

5. Operational Advantages

The liquid discharging apparatus 1 according to the embodiment is a liquid discharging apparatus that performs serial printing by moving the carriage 24 on which the head 21 is mounted, and the drive substrate 30 including the drive signal generating unit 31 that generates the drive signals COM-A and COM-B is separately provided from the head unit 20 including the carriage 24 on which the head 21 is mounted and from the control substrate 10 on which the control signal generating unit 100 generating the original drive differential signals dDSA and dDSB for controlling the generation of the drive signals COM-A and COM-B is mounted.

The drive substrate 30 is disposed so as to overlap the region where the carriage 24 moves, and the shortest distance between the drive substrate 30 and the carriage 24 is set so as to be shorter than the shortest distance between the control substrate 10 and the carriage 24. That is, the drive substrate 30 is disposed closer to the head unit 20 including the carriage 24 than the control substrate 10.

Consequently, it is possible to make the cable 19 (FFC 194) through which the drive signals COM-A and COM-B output from the drive substrate 30 are transmitted shorter while suppressing an increase in size of the head unit 20 including the carriage 24. It is possible to reduce the inductance and impedance of the cable 19 (FFC 194) through which the drive signals COM-A and COM-B are transmitted. Therefore, it is possible to reduce distortion of the drive signals COM-A and COM-B attributable to an increase in the length of the cable 19 (FFC 194) through which the drive signals COM-A and COM-B are transmitted, and to transmit the drive signals COM-A and COM-B to the piezoelectric elements 60 included in the head 21 with high accuracy. It is possible to improve the reliability of the liquid discharging apparatus 1.

According to the liquid discharging apparatus 1 of the embodiment, by disposing the drive substrate 30 in the middle portion of the region where the carriage 24 moves, it is possible to make the wired length of cable 19 (FFC 194) through which the drive signals COM-A and COM-B are transmitted even shorter. Accordingly, it is possible to further reduce the inductance and impedance of the cable 19 (FFC 194) through which the drive signals COM-A and COM-B are transmitted. Therefore, it is possible to reduce distortion of the drive signals COM-A and COM-B attributable to an increase in the length of the cable 19 (FFC 194) through which the drive signals COM-A and COM-B are transmitted, and to transmit the drive signals COM-A and COM-B to the piezoelectric elements 60 included in the head 21 with high accuracy. It is possible to further improve the reliability of the liquid discharging apparatus.

According to the liquid discharging apparatus 1 of the embodiment, the control substrate 10 is provided outside the region where the carriage 24 moves and a liquid is discharged onto a medium. Accordingly, the sticking of the discharged liquid to the control substrate 10 can be reduced. Therefore, the occurrence of a breakdown caused by an insulation failure of the control substrate 10 resulting from the sticking of the liquid is reduced, and thus it is possible to further improve the reliability of the liquid discharging apparatus 1.

By providing the control substrate 10 outside the region where the carriage 24 moves and discharging a liquid onto a medium, the control substrate is disposed so as to be separated away from the drive substrate 30 that is provided in the region where the carriage 24 moves. That is, it is possible to reduce an effect of heat generated in the drive substrate 30 on the control substrate 10. Therefore, it is possible to reduce changes in characteristics of the control substrate 10 caused by the heat and the occurrence of a breakdown (for example, a short life) caused by thermal degradation. It is also possible to improve the reliability of the liquid discharging apparatus.

In the liquid discharging apparatus 1 according to the embodiment, in a case where the maximum width that allows serial printing is equal to or larger than 24 inches and is equal to or smaller than 75 inches, the impedance and inductance of a signal line increase since the entire length of the signal line through which the drive signals COM-A and COM-B are transmitted is approximately 1 m to 3 m. Therefore, according to the liquid discharging apparatus 1 of the embodiment, the effect described above, which is obtained by reducing the impedance and inductance of the signal line, is even larger.

In addition, the liquid discharging apparatus 1 according to the embodiment can achieve excellent printing accuracy and printing stability as a 24-inch corresponding printer, a 36-inch corresponding printer, a 44-inch corresponding printer, or a 64-inch corresponding printer, which is in particularly high demand.

6. Modification Example

Although a piezoelectric liquid discharging apparatus in which a drive circuit drives a piezoelectric element (capacitive load) as a driving element is given as an example in the embodiment described above, the invention is also applicable to a liquid discharging apparatus in which a drive circuit drives a driving element other than a capacitive load. As an example of such a liquid discharging apparatus, a thermal (bubble type) liquid discharging apparatus, in which a drive circuit drives a heater element (for example, a resistance) as a driving element and a liquid is discharged using bubbles generated by the heater element being heated, can be given.

Although a printing apparatus such as a printer is given as an example of a liquid discharging apparatus in the embodiment described above, the invention may be a liquid discharging apparatus that discharges a liquid onto a medium having a size of A3 or larger, and is also applicable to liquid discharging apparatuses including a color material discharging apparatus used in manufacturing color filters, such as a liquid crystal display, an electrode material discharging apparatus used in forming electrodes, such as an organic EL display and a field emission display (FED), a bioorganic material discharging apparatus used in manufacturing biochips, a three-dimensional modelling apparatus (so-called 3D printer), and a textile printing apparatus.

Although the embodiment or the modification example has been described, the invention is not limited to the embodiment or the modification example, and can be carried out in various forms without departing from the spirit of the invention. For example, the embodiment and each modification example described above can be combined as appropriate.

The invention includes practically the same configuration (for example, a configuration of which a functions, a method, and a result are the same or a configuration of which an object and an advantage are the same) as the configuration described in the embodiment. The invention includes a configuration where an inessential portion of the configuration described in the embodiment is substituted. The invention includes a configuration with which the same operational advantages described in the embodiment are achieved or a configuration with which the same object can be accomplished. In addition, the invention includes a configuration where a known technique is added to the configuration described in the embodiment.

The entire disclosure of Japanese Patent Application No. 2017-056642, filed Mar. 22, 2017 is expressly incorporated by reference herein.

What is claimed is:

1. A liquid discharging apparatus that performs serial printing onto a medium having a size of an A3 short side width or larger, the apparatus comprising:

a print head that includes a driving element and discharges a liquid when a drive signal is applied and the driving element is driven;

a carriage that is mounted on the print head and moves with respect to the medium;

a control signal generation circuit that generates a drive signal generation control signal for controlling generation of the drive signal;

a drive signal generation circuit that generates the drive signal based on the drive signal generation control signal;

a first cable through which the drive signal generation control signal is transmitted from the control signal generation circuit to the drive signal generation circuit;

a second cable through which the drive signal is transmitted from the drive signal generation circuit to the print head;

a control circuit substrate on which the control signal generation circuit is provided; and a drive circuit substrate on which the drive signal generation circuit is provided, wherein the shortest distance between the control circuit substrate and the moving carriage is longer than the shortest distance between the drive circuit substrate and the moving carriage, and the drive circuit substrate is provided at a position where a region in which the carriage moves and at least a part of the drive circuit substrate overlap each other when seen in a direction orthogonal to a direction where the carriage moves.

2. The liquid discharging apparatus according to claim 1, wherein at least a part of the drive circuit substrate is provided in a middle portion of the region in which the carriage moves when seen in the direction orthogonal to the direction where the carriage moves.

3. The liquid discharging apparatus according to claim 1, wherein at least a part of the control circuit substrate is provided outside the region in which the carriage moves when seen in the direction orthogonal to the direction where the carriage moves.

4. The liquid discharging apparatus according to claim 1, wherein a maximum width that allows the serial printing is equal to or larger than 24 inches and is equal to or smaller than 75 inches.

5. The liquid discharging apparatus according to claim 1, wherein a maximum width that allows the serial printing corresponds to any width of the media of 24 inches, 36 inches, 44 inches, and 64 inches.

6. The liquid discharging apparatus according to claim 1, wherein the drive signal generation control signal is a digital signal, the drive signal generation circuit generates an underlying drive signal, which is an underlying analog signal of the drive signal, based on the drive signal generation control signal, and the drive signal generation circuit power-amplifies the underlying drive signal to generate the drive signal.

7. The liquid discharging apparatus according to claim 1, wherein the drive signal generation control signal is a differential signal, the first cable includes first wiring, second wiring, third wiring, fourth wiring, fifth wiring, and sixth wiring, the differential signal is transmitted through the second wiring and the third wiring, a constant voltage signal is transmitted through the first wiring, the fourth wiring, the fifth wiring, and the sixth wiring, the second wiring and the fifth wiring are disposed so as to oppose each other, and the third wiring and the sixth wiring are disposed so as to oppose each other.

8. The liquid discharging apparatus according to claim 1, further comprising:

a state detection circuit that is mounted on the carriage, detects a state of the print head, and generates a state signal, which is an analog signal indicating the state of the print head;

a conversion circuit that is provided on the drive circuit substrate and converts the state signal to a digital signal;

a third cable through which the state signal is transmitted from the state detection circuit to the conversion circuit; and a fourth cable through which the state signal converted to the digital signal is transmitted from the conversion circuit to the control signal generation circuit.

9. The liquid discharging apparatus according to claim 1, wherein the print head discharges the liquid at a frequency of 30 kHz or higher.

* * * * *